US008037853B2

(12) United States Patent
Luercho

(10) Patent No.: US 8,037,853 B2
(45) Date of Patent: Oct. 18, 2011

(54) INTERNAL COMBUSTION ENGINE WITH ELECTRONIC VALVE ACTUATORS AND CONTROL SYSTEM THEREFOR

(75) Inventor: Hector Eduardo Luercho, Buenos Aires (AR)

(73) Assignee: Len Development Services USA, LLC, Lancaster, VA (US)

( * ) Notice: Subject to any disclaimer, the term of this patent is extended or adjusted under 35 U.S.C. 154(b) by 954 days.

(21) Appl. No.: 11/837,505

(22) Filed: Aug. 11, 2007

(65) Prior Publication Data

US 2007/0272179 A1 Nov. 29, 2007

Related U.S. Application Data

(63) Continuation-in-part of application No. 10/907,884, filed on Apr. 19, 2005, now Pat. No. 7,270,093.

(51) Int. Cl.
*F01L 9/04* (2006.01)

(52) U.S. Cl. ..... 123/90.11; 251/129.01

(58) Field of Classification Search ..... 123/90.11; 251/129.01, 129.21

See application file for complete search history.

(56) References Cited

U.S. PATENT DOCUMENTS

| | | | | |
|---|---|---|---|---|
| 4,692,999 | A | 9/1987 | Frandsen | |
| 4,794,890 | A | 1/1989 | Richeson, Jr. | |
| 4,813,647 | A | 3/1989 | Yagi et al. | |
| 4,829,947 | A | 5/1989 | Lequesne | |
| 4,841,923 | A | 6/1989 | Buchl | |
| 4,984,541 | A | 1/1991 | Kawamura | |
| 5,072,700 | A | 12/1991 | Kawamura | |
| 5,124,598 | A | 6/1992 | Kawamura | |
| 5,406,241 | A | 4/1995 | Kawamura | |
| 5,467,962 | A | 11/1995 | Bircann et al. | |
| 5,669,341 | A | 9/1997 | Ushirono et al. | |
| 5,983,847 | A | 11/1999 | Miyoshi et al. | |
| 6,013,959 | A | 1/2000 | Hoppie | |
| 6,037,851 | A | 3/2000 | Gramann et al. | |
| 6,039,014 | A * | 3/2000 | Hoppie | 123/90.11 |
| 6,092,495 | A | 7/2000 | Hackett | |
| 6,158,403 | A | 12/2000 | Berecewicz et al. | |
| 6,182,620 | B1 | 2/2001 | Cristiani et al. | |
| 6,276,318 | B1 | 8/2001 | Yanai et al. | |
| 6,278,932 | B1 | 8/2001 | Baumel et al. | |
| 6,286,478 | B1 | 9/2001 | Atago et al. | |
| 6,390,036 | B1 | 5/2002 | Yuuki | |
| 6,477,993 | B1 | 11/2002 | Katsumata et al. | |
| 6,532,919 | B2 | 3/2003 | Curtis et al. | |
| 6,568,359 | B2 | 5/2003 | Pischinger et al. | |
| 6,651,618 | B1 | 11/2003 | Coleman et al. | |
| 6,679,204 | B2 * | 1/2004 | Iida et al. | 123/90.11 |
| 6,688,280 | B2 | 2/2004 | Weber et al. | |
| 6,946,761 | B2 * | 9/2005 | Galburt | 310/52 |
| 7,128,032 | B2 * | 10/2006 | Froeschle et al. | 123/90.11 |

FOREIGN PATENT DOCUMENTS

JP 05-018220 1/1993

* cited by examiner

*Primary Examiner* — Ching Chang
(74) *Attorney, Agent, or Firm* — Alvin R. Wirthlin

(57) ABSTRACT

A valve assembly for an internal combustion engine includes a stationary permanent magnet assembly having at least one permanent magnet for generating a permanent magnetic field and a movable coil assembly having at least one coil of electrically conductive material for generating a magnetic field when an electrical current is applied to the at least one coil to thereby move the coil assembly with respect to the permanent magnet assembly. A valve is connected to the coil assembly for movement therewith. The valve assembly also includes a housing with an internal cavity and spaced ports extending from the cavity to circulate liquid through the cavity and cool the valve assembly during operation.

15 Claims, 34 Drawing Sheets

INTERNAL COMBUSTION ENGINE WITH ELECTRONIC VALVE ACTUATORS AND CONTROL SYSTEM THEREFOR

RELATED APPLICATIONS

This application is a Continuation-in-Part of U.S. application Ser. No. 10/907,884 filed on Apr. 19, 2005.

BACKGROUND OF THE INVENTION

The present invention relates generally to linear actuators, and more particularly to electronically controlling engine operation through electrically operated valves, systems, and methods.

Conventional internal combustion engines include a camshaft and associated linkages to open and close intake and exhaust valves during engine operation. Since the valve timing is determined during design and manufacturing and remains fixed throughout the life of the engine, there is no room for engine performance enhancement based on variable valve timing. The fixed valve timing selected for a particular engine generally requires a compromise between engine performance, fuel economy, and emissions. It is desirable to dynamically vary valve timing based on current engine operating parameters to optimize engine performance, fuel economy, and emissions as well as to provide engine braking functions.

Although a number of approaches have been attempted for varying valve timing and engine control, many have been found impractical to implement. While hydraulically controlled valve actuators provide some benefits associated with variable valve timing, electronic or electromagnetic actuators are more versatile for a variety of applications since they allow direct electronic control of valve timing and displacement. However, prior art electromagnetic actuators that employ the movement of relatively heavy mobile permanent magnetic core or mobile coil armature assemblies require high voltages and currents to operate. For example, some prior art systems may require 42 volts or more and amperages upwards of 30 amps or more per electromagnetic actuator to operate. When many actuators are used, such as twelve actuators for a twelve-valve six-cylinder engine, the power requirements quickly become too excessive for practical implementation. In addition, in order to increase the power output of such prior art systems, a notable increase in weight of the mobile permanent magnet core or mobile coil armature assemblies is required, thereby producing a disproportionate increase in energy consumption to operate the valves. Energy efficiency of the actuator should thus be considered so that the benefits of variable valve timing are not defeated by additional power requirements of the actuator as compared to mechanical or hydromechanical systems.

BRIEF SUMMARY OF THE INVENTION

According to one aspect of the invention, a linear actuator includes a permanent magnet assembly having at least one permanent magnet for generating a permanent magnetic field; a coil assembly having at least one coil of electrically conductive material for generating a temporary magnetic field to thereby move one of the coil assembly and permanent magnet assembly with respect to the other of the coil assembly and permanent magnet assembly; and a heat transfer unit surrounding at least a portion of the movable coil assembly for removing heat generated by the at least one coil during operation.

According to a further aspect of the invention, an electronic valve assembly for an internal combustion engine includes the above-described linear actuator together with a valve having a valve stem with one end connected to the movable coil assembly and a valve head connected to an opposite end of the valve stem. The valve is movable with the coil assembly between a closed position wherein the valve head is adapted for contacting a valve seat and an open position wherein the valve head is spaced from the valve seat.

According to yet a further aspect of the invention, an internal combustion engine includes at least two electronic valve assemblies as described above together with an engine block having a cylinder, a piston having a piston head for reciprocal movement in the cylinder, and a cylinder head connected to the engine block. The cylinder head has an intake port and an exhaust port. One of the electronic valve assemblies is operable to open and close the intake port and the other of the electronic valve assemblies is operable to open and close the exhaust port.

According to an even further aspect of the invention, an electronic valve assembly includes a housing having upper and lower magnet support portions. A permanent magnet assembly, with at least one permanent magnet for generating a permanent magnetic field, is rigidly connected to the upper and lower magnet support portions. A coil assembly surrounds the permanent magnet assembly within the housing and includes at least one coil of electrically conductive material for generating a temporary magnetic field to thereby move the coil assembly in an axial direction with respect to the permanent magnet assembly. Upper and lower coil support portions are rigidly connected to upper and lower ends, respectively, of the coil assembly. An upper coil suspension member has an upper outer ring rigidly connected to the upper magnet support portion, an upper inner ring rigidly connected to the upper coil support portion, and an upper flexible circular panel extending between the upper outer and inner rings. A lower coil suspension member has a lower outer ring rigidly connected to the lower magnet support portion, a lower inner ring rigidly connected to the lower coil support portion, and a lower flexible circular panel extending between the lower outer and inner rings. A valve has a valve stem with one end connected to the lower coil support portion and a valve head connected to an opposite end of the valve stem. The valve is movable with the coil assembly between a closed position wherein the valve head is adapted for contacting a valve seat and an open position wherein the valve head is spaced from the valve seat.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings may not necessarily be to scale. The invention will now be described in greater detail with reference to the accompanying drawings.

DETAILED DESCRIPTION OF THE INVENTION

Figure 1:
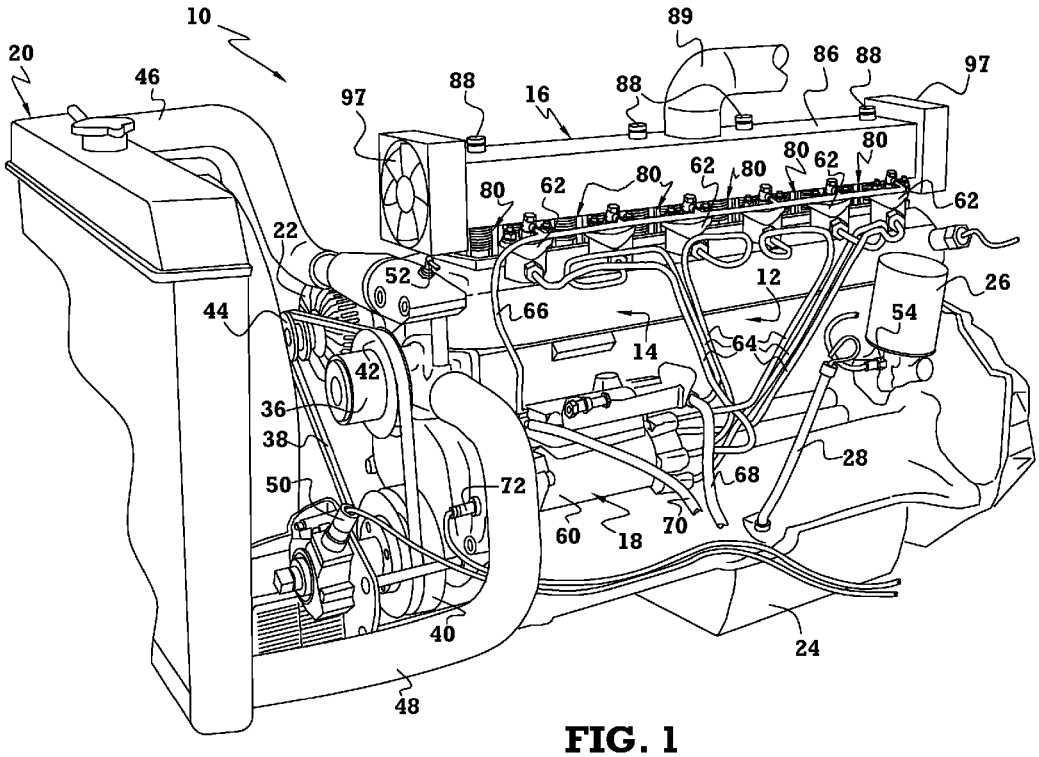
FIG. 1 is a first side perspective view of an internal combustion engine in accordance with an exemplary embodiment of the present invention.
Figure 2:
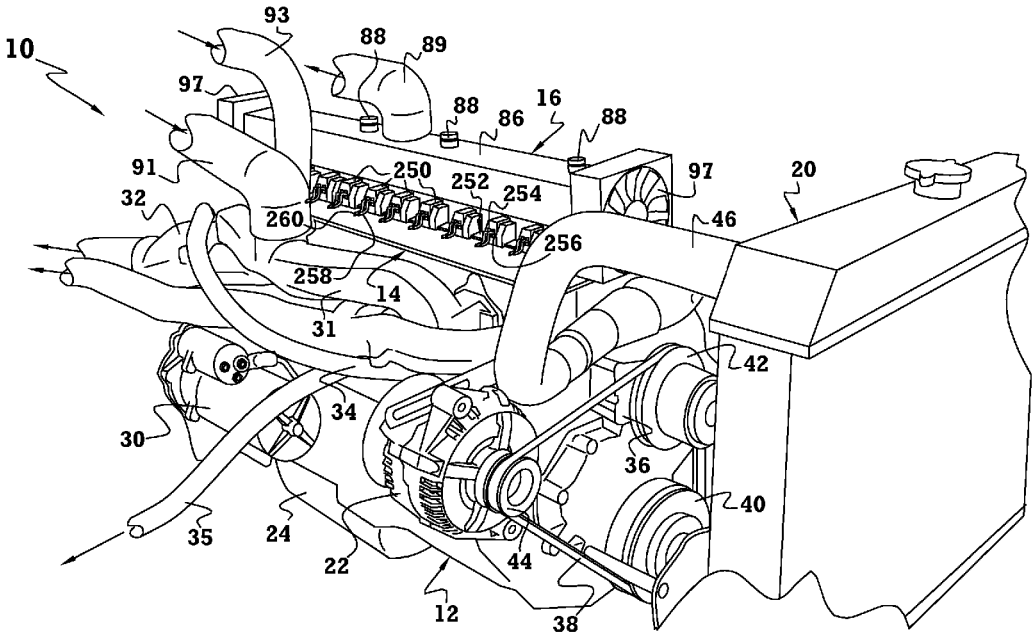
FIG. 2 is a second side perspective view of the engine of FIG. 1.

Referring to the drawings, and to FIGS. 1 and 2 in particular, an exemplary embodiment of an internal combustion engine 10 in accordance with the present invention is illustrated. The engine 10 as shown, is representative of an inline six-cylinder turbocharged diesel engine. However, it will be understood that the engine 10 can be embodied as any internal combustion engine with any number of cylinders and cylinder orientations or configurations, including spark or compression ignition of the two-cycle or four-cycle type and, as will be described in further detail below, an engine that is changeable between two cycles and four cycles in accordance with a further embodiment of the invention, as well as hybrid engines.

The engine 10 in accordance with the present invention includes an engine block 12, a cylinder head 14 mounted to the engine block 12, an electronic valve system 16 mounted to the cylinder head 14, a fuel distribution system 18 for delivering fuel to the cylinder head, a radiator 20 located forwardly of the engine block 12, an alternator 22 mounted to the engine block, an oil pan 24 located under the engine block, an oil filter 26 and oil dipstick tube 28 extending above the engine block, a starter motor 30 adapted for engaging a ring gear (not shown) associated with the engine crank shaft for starting the engine 10, a water pump 36 connected between the engine block 12 and/or cylinder head 14 and the radiator 20 for returning heated coolant to the radiator and delivering cooled coolant to the engine, an intake manifold 31 and exhaust manifolds 32 and 34 connected to the cylinder head 14.

Of particular note is an auxiliary exhaust conduit 35 connected to the engine block 12, preferably at a position below the manifolds 32 and 34, the purpose of which will be described in greater detail below.

A continuous belt 38 loops over the crankshaft pulley 40, water pump pulley 42 and the alternator pulley 44 in a well known manner to drive the water pump and alternator from rotation of the crankshaft 55 (FIG. 21) as the engine 10 is operated. A coolant supply hose 46 extends between one side of the water pump 36 and an upper end of the radiator 20 and a coolant return hose 48 extends between the lower end of the radiator and the water pump. A temperature sensor 52 is mounted near the water pump 36 for monitoring the coolant temperature. An oil pressure sensor 54 is mounted adjacent the oil filter 26 for monitoring the oil pressure.

Notably missing from the engine 10 of the present invention is the complex mechanical connection between the crankshaft pulley 40 (or other rotatable member) and the valve system 16. For an engine configuration as shown in FIGS. 1 and 2, the provision of an electronic valve system 16 results in the elimination of approximately 200 parts including cog belts, cog wheels, chains, tensioners, camshafts, camshaft supports, tappets, valve lifters, rocker arms, rocker arm supports, springs, spring supports, washers, and so on. The elimination of these parts results in significant weight reduction, cost savings, power increase, greater reliability, as well as operating flexibility for dynamically changing power and other parameters to accommodate varying operating conditions, such as engine load requirements.

A crank angle sensor 50 is positioned in proximity to the crankshaft pulley 40 for measuring the rotational position of the crankshaft 55 (FIG. 21) as well as a complete rotation of the crankshaft during startup and operation, as will be described in further detail below. Preferably, the crank angle sensor 50 is of the inductive type and is capable of sensing 360 degrees of rotation with an angular resolution of at least one degree. However, it will be understood that the crank angle sensor may have higher or lower resolution, depending on the amount of accuracy desired, response time of the electronic valve system 16, number of cylinders, the particular engine type, and so on.

The fuel distribution system 18 includes a fuel injector pump 60 connected to fuel injectors 62 through fuel distribution lines 64 and a fuel return line 66. Each of the fuel injectors 62 is operably associated with one of the cylinders 65 (FIG. 22) formed in the engine block 12. The fuel injector pump 60 is connected to a fuel tank (not shown) via a fuel supply hose 68 and a fuel return hose 70. A fuel filter (not shown) may be positioned between the pump 60 and the tank. A fuel injection sensor 72 is associated with the fuel distribution system 18 detects the rotational position of the fuel injector pump 60. Preferably, the fuel injection sensor 72 is of the inductive type.

Figure 3:
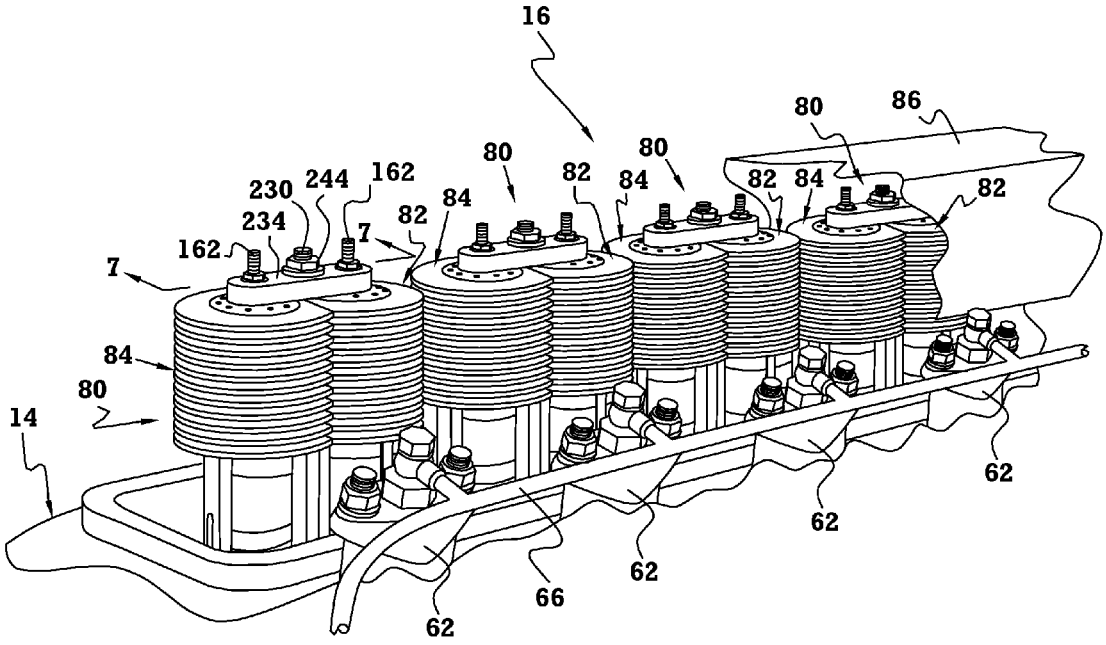
FIG. 3 is an enlarged perspective view of an electronic valve system in accordance with the present invention.
Figure 22:
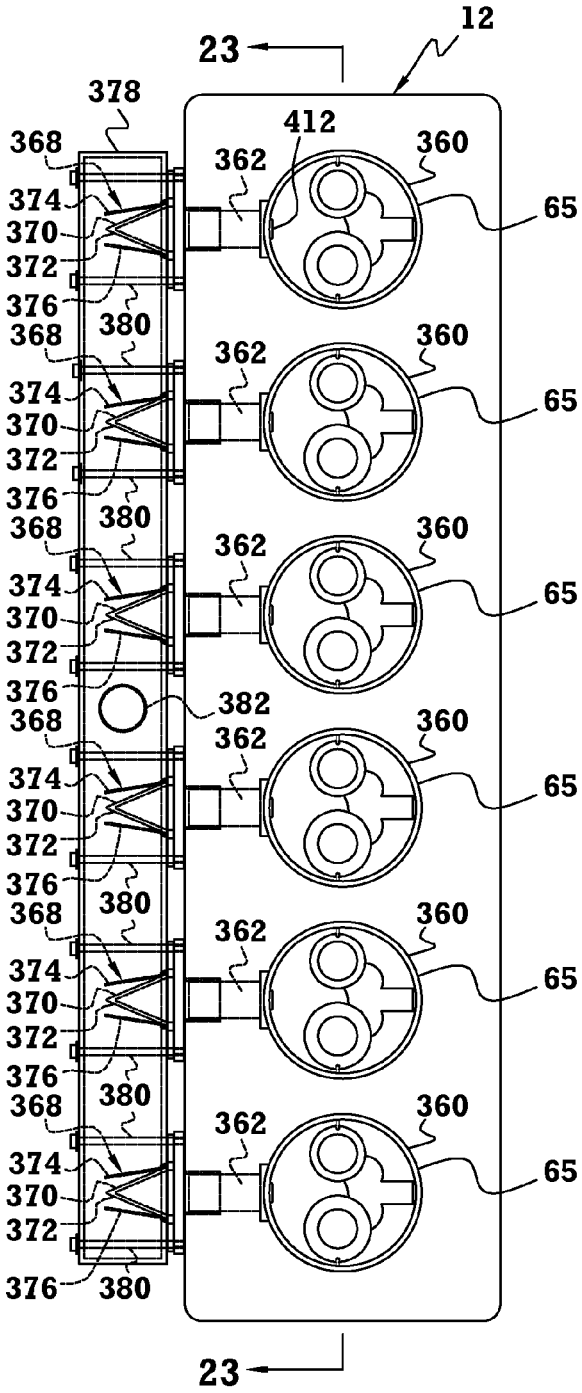
FIG. 22 is a top plan view of an engine block in accordance with the present invention.

With further reference to FIG. 3, the electronic valve system 16 preferably includes pairs 80 of electronic intake valve assemblies 82 and electronic exhaust valve assemblies 84 mounted to the cylinder head 14, with each pair 80 being aligned with a separate cylinder 65 (FIG. 22). It will be understood that more than one intake valve assembly 82 and/or exhaust valve assembly 84 can be associated with each cylinder depending on the type of engine and its particular configuration. A valve cover 86 extends over the pairs 80 and is preferably connected to the cylinder head 14 by way of thumbscrews 88 and threaded studs (not shown) that extend upwardly from the cylinder head 14 and through the valve cover 86. It will be understood that other fastening means for connecting the valve cover 86 is contemplated, such as clamps, latches or other interlocking members, straps, and so on.

As best shown in FIG. 2, a first air hose 89 extends from the valve cover 86 to a filter device (not shown) while a second air hose 91 extends from the filter device to the intake manifold 31 and a third air hose 93 extends between a filter device (not shown) and the intake manifold 31. An electric ventilator fan 97 may be positioned at one or both ends of the valve cover 86 for drawing in cool air from outside and forcing the cool air across the pairs 80 of intake valve assemblies 82. A temperature sensor (not shown) may be located for sensing temperature within the valve cover 86 for activating and deactivating the electric ventilator fans 97. The air from inside the valve cover 86 is then diverted into the intake manifold through the first and second hoses 91, 93 for delivery to the combustion chambers. This arrangement is especially advantageous since the intake valve assemblies 82 are cooled through convective heat transfer and the air passing over the valve assemblies is heated before entering the intake manifold. Although not shown, a turbine, such as found in turbochargers or superchargers, may be installed in the air passageway for increasing the volume of air to the combustion chambers in a well-known manner.

Referring now to FIGS. 4, 5, 5A and 6, the exhaust valve assembly 84 will now be described, it being understood that the intake valve assembly 82 is preferably constructed in a similar manner, with the exception of some noted distinctions that will be elucidated below. Like parts for both the intake and exhaust valve assemblies are therefore labeled with like numerals. The exhaust valve assembly 84 preferably includes a stationary housing assembly 90, a stationary permanent magnet assembly 92 fixed within the housing assembly, a mobile coil assembly 94 that surrounds the permanent magnet assembly 92 and is mounted for reciprocal movement in the housing assembly, a valve 96 mounted to the coil assembly 94, and a heat transfer unit 98 surrounding an upper portion of the housing assembly.

The stationary housing assembly 90 includes a housing 95 and a cap 120 connected to the housing. The housing 95 has an upper section 100 with a generally cylindrical wall 102 and a lower section 104 with a pair of legs 106, 108 that extend downwardly from diametrically opposite sides of the wall 102 and terminate at a stepped ring 110. A slot 112 is formed in the leg 106. An upper wall 114 extends radially inwardly from the wall 102 and includes a threaded opening 116.

The cap 120 has an upper mounting section 122 and a lower threaded section 124 that extends downwardly from the upward mounting section and engages the threaded opening 116 of the upper wall 114. The upper mounting section 122 has an upper wall 126 with an annular flange 128 that extends radially therefrom. The annular flange 128 abuts the upper wall 114 of the upper housing section 100 when the cap 120 is threaded into the opening 116. The upper wall 126 is preferably generally disk-shaped with a pair of diametrically opposed flats 130 for engagement by a wrench or the like during assembly/disassembly. An annular boss 132 extends upwardly from the upper wall 126. A threaded opening 134 extends through both the annular boss 132 and upper wall 126. A plurality of upper ventilation apertures 136 extend through the upper wall 126 of the cap 120 to allow heated air (that may be generated by the coil assembly 94) to escape from the housing assembly 90 and into the valve cover 86 (FIGS. 1 and 2) where it can be dissipated by the ventilator fans 97.

Figure 6:
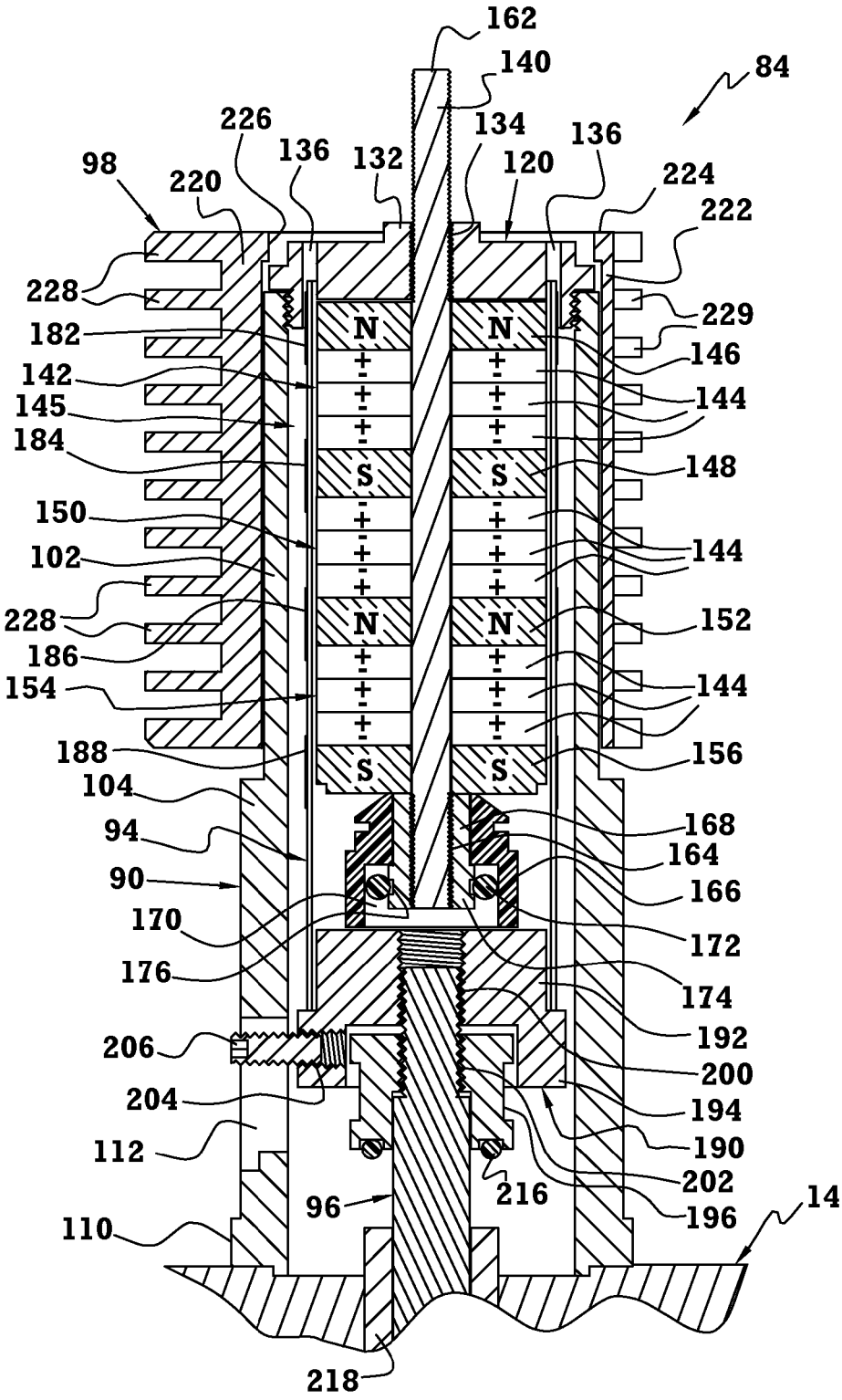
FIG. 6 is an enlarged sectional view of the intake valve assembly taken along line 6-6 of FIG. 5.
Figure 8:
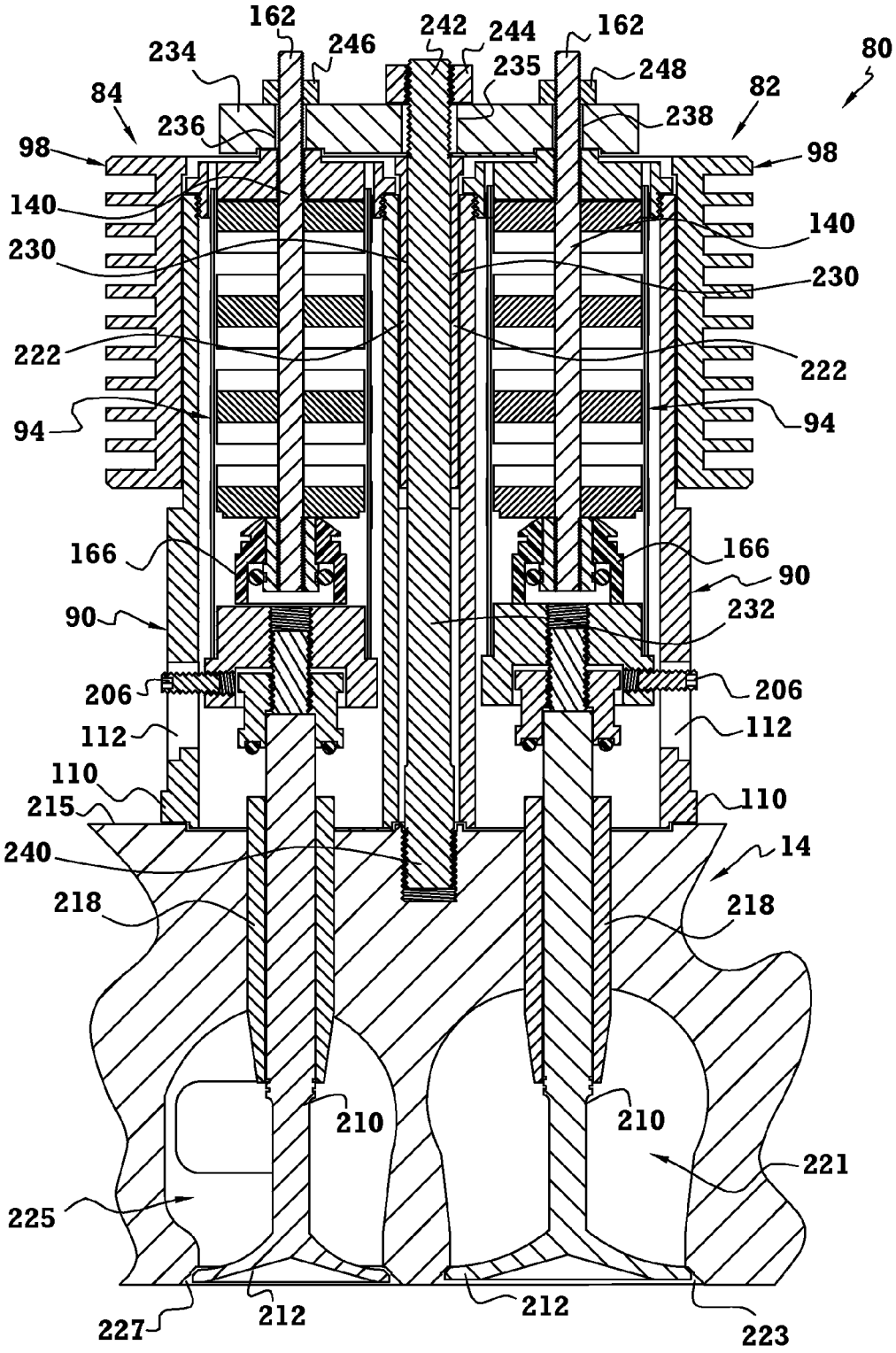
FIG. 8 is a sectional view similar to FIG. 7 with the valves in the closed position.

The permanent magnet assembly 92 preferably includes an upper set 142 of stacked permanent magnets 144 sandwiched between spacers 146 and 148, a middle set 150 of stacked permanent magnets 144 sandwiched between spacers 148 and 152, and a lower set 154 of stacked permanent magnets 144 sandwiched between spacers 152 and 156. The permanent magnets 144 and spacers 146, 148, 152, and 156 are preferably in the form of annular disks with central openings 158 and 160, respectively, through which a rod 140 extends. The rod 140 has a threaded upper end 162 that engages the threaded opening 134 of the cap 120 and a threaded lower end 164 that receives an upper shock absorber 166 and a threaded sleeve nut 168. The upper shock absorber 166 is preferably in the form of a resilient bushing with a stepped bore 170 sized to receive the sleeve nut 168 and an O-ring 172 that fits within an annular groove 176 formed in a lower faceted portion 174 of the sleeve nut. The upper shock absorber 166 is operative to contact the lower-most spacer 160 of the permanent magnet assembly 92 and dampen upper movement of the coil assembly 94 as the coil assembly 94 moves toward the upper-most or closed position, as shown in FIGS. 6 and 8. The O-ring 172 helps to maintain alignment of the upper shock absorber 166 when compressed during upward movement of the coil assembly 94. Preferably, the upper shock absorber 166 and O-ring 172 are constructed of an elastomeric material, such as Viton™ or other synthetic rubber.

When assembled, the permanent magnets and spacers are compressed between the cap 120 and the sleeve nut 168, while the bushing 166 is held in place by the lower faceted portion of the sleeve nut. With this arrangement, the permanent magnet assembly 92 is fixed against movement with respect to the housing 100. The permanent magnet assembly 92 together with the housing 100 form an annular air gap 145 (FIG. 6) within which the coil assembly 94 reciprocates in an axial direction. It will be understood that the permanent magnet assembly 92 can be connected together and/or mounted to the housing 100 through other fastening arrangements, such as employing different types of fasteners, welding, adhesive bonding, clamping, press-fitting, and so on.

Each permanent magnet set 142, 150 and 154 preferably includes three permanent magnets 144 that are axially stacked together in axially oriented North-South pole relationships such that the axially extending magnetic North ("+") of one magnet faces the axially extending magnetic South ("−") of an adjacent magnet for mutual magnetic attraction. In addition, the sets 142 and 150 face the spacer 148 with South poles to magnetically repulse each other and induce a radially extending South polarity in the spacer 148. Likewise, the sets 150 and 154 face the spacer 152 with North poles to magnetically repulse each other and induce a radially extending North polarity in the spacer 152. Furthermore, a radially extending North polarity is induced in the spacer 146 while a radially extending South polarity is induced in the spacer 156. It will be understood that the permanent magnets 144 may alternatively have radially oriented polarities.

In accordance with one exemplary embodiment of the invention, each permanent magnet 144 is preferably constructed of a neodymium-iron-boron material with a temperature rating of approximately 120° C. Since the disclosed system of the exemplary embodiment operates at a temperature between about 65° C. and 70° C., a permanent magnet with a higher temperature rating should not be needed. However, it will be understood that permanent magnets with different materials and/or higher or lower temperature ratings can be used. For example, a permanent magnet constructed of samarium-cobalt with a temperature rating of about 350° C. could alternatively be used. In accordance with the one exemplary embodiment of the invention, each permanent magnet 144 may have a diameter of approximately 24 mm and a thickness of approximately 3 mm. Likewise, each spacer 146, 148, 152 and 156 may have a diameter of approximately 24 mm and a thickness of approximately 5 mm. It will be understood that the dimensions of the spacers and permanent magnets, as well as the number of spacers, permanent magnets within a set, and the number of sets, can greatly vary depending on available space, desired power output and/or valve stroke length for a particular engine.

Preferably, the housing 95 and spacers 146, 148, 152 and 156 are constructed of a magnetically permeable material, while the cap 120 and the rod 140 are constructed of a non-magnetic material, such as 316L stainless steel, since the magnetic circuits 266, 268 and 269 (FIGS. 9 and 10) close between the spacers, housing and permanent magnets. In accordance with one exemplary embodiment of the invention, the housing and spacers may be constructed of an iron-based material having approximately 0.02% carbon, 0.31% manganese, 0.01% silicon, 0.013% phosphorus, and 0.015% sulfur. This material is preferably thermally treated in order to globulize the perlite and thus obtain a ferrous matrix with low iron carbide content. Consequently, the housing and spacers feature a high magnetic permeability with a saturation point of around 22,000 Gauss to achieve a magnetic field of over 11,000 Gauss between the housing 100 and each spacer 146, 148, 152, and 156 with the above-described permanent magnet material and dimensions. It will be understood that other materials for the housing, spacers, cap and rod can be used. By way of example, it has been found that the coil assembly 94 can adequately function even when the spacers are constructed with non-ferromagnetic material. Thus, the spacers, cap and rod may be constructed of suitable non-magnetic metals such as aluminum, composite materials, plastics, and so on.

The coil assembly 94 preferably includes a thin, generally cylindrically-shaped spool 180, a plurality of conductive coils 182, 184, 186, and 188 wrapped around the spool, and a lower mounting base 190 connected to a lower end of the spool. The number of coils preferably matches the number of spacers, although there may be more or less coils and/or spacers. In accordance with one exemplary embodiment of the invention, the spool 180 is preferably constructed of a light-weight non-ferromagnetic material, such as duraluminum. However, it will be understood that other materials or combinations of materials can be used, such as aluminum, composites such as carbon fiber/epoxy, plastics, and so on.

Figure 9:
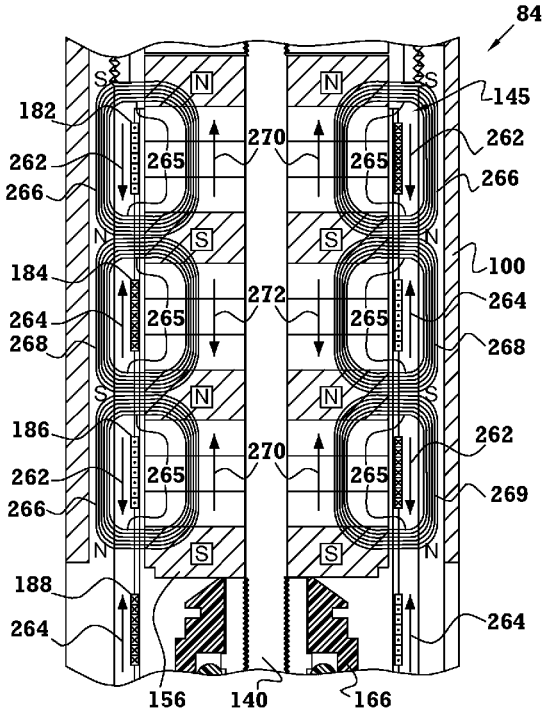
FIG. 9 is an enlarged sectional view of a portion of the exhaust valve assembly showing the interaction of magnetic forces during operation of the valve in the FIG. 7 position.
Figure 10:
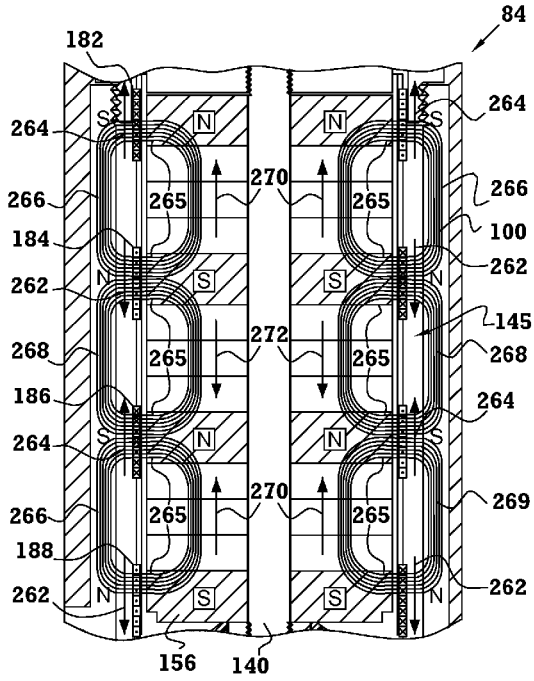
FIG. 10 is an enlarged sectional view of a portion of the exhaust valve assembly showing the interaction of magnetic forces during operation of the valve in an opposite direction in the FIG. 8 position.

As shown most clearly in FIGS. 9 and 10, in an effort to keep the coil assembly 94 as light weight as possible, each coil 182, 184, 186 and 188 is preferably formed by wrapping an insulated conductor around the spool 180 in a single layer with a predetermined number of turns. The coils are interconnected with each successive coil wrapping in a different direction from the preceding coil as represented by "X" and "•" (dot) nomenclatures to thereby produce opposite polar orientations. In accordance with one exemplary embodiment of the invention, each coil 182, 184, 186 and 188 is formed by wrapping a single layer of 0.25 mm thick×0.7 mm wide copper ribbon around the spool approximately 30-40 times to create a cross sectional area of approximately 5.25 $mm^2$ for each coil and a total area of 21 $mm^2$ for all four coils. For the exemplary embodiment, the diameter of the spool 180 and thus the coils is preferably about 26 mm. It will be understood that other insulated conductor materials may be used for the coils. For example, an insulated aluminum ribbon with the same width and thickness and the same number of windings will reduce the weight of the coils by approximately one third of the insulated copper ribbon weight. The coils can be fixedly secured to the spool through potting, adhesive bonding, taping, or other well-known attachment means. The spaces between the coils can also be occupied by similar attachment means.

Figure 4:
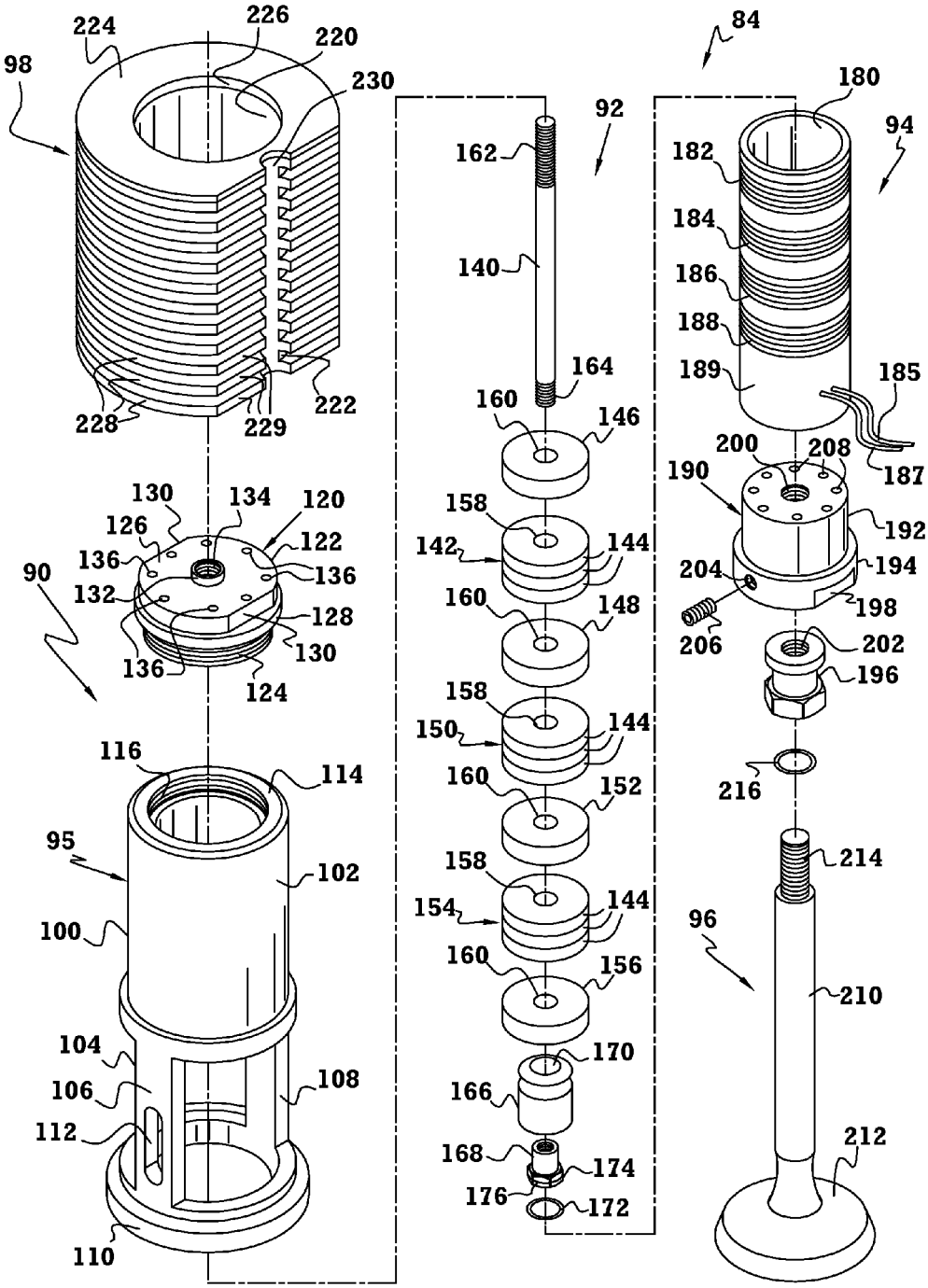
FIG. 4 is an exploded perspective view of an intake valve assembly that forms part of the electronic valve system.

As shown in FIG. 4, a single pair of leads 185, 187 preferably extends from a layer 189 of electrically insulating material at a lower end of the spool 180 for electrical connection to control circuitry (FIG. 11) for controlling movement of the valves between open and closed positions, as will be described in greater detail below. The insulating layer 189 can comprise an elastomeric or epoxy coating, adhesive tape, insulating strips of material, and so on. The leads 185, 187 can be an extension of the coil wires or tape or may alternatively be connected to the coils through crimping, soldering, or the like. Since the leads 185 will be subject to flexing or bending during coil movement, it is preferred that the leads be constructed of a flexible material. In accordance with a further embodiment of the invention, the leads 185, 187 may be constructed as ribbon wires or slide wires, or may be replaced with contact brushes or other electrical transmission means that accommodates movement.

Figure 5:
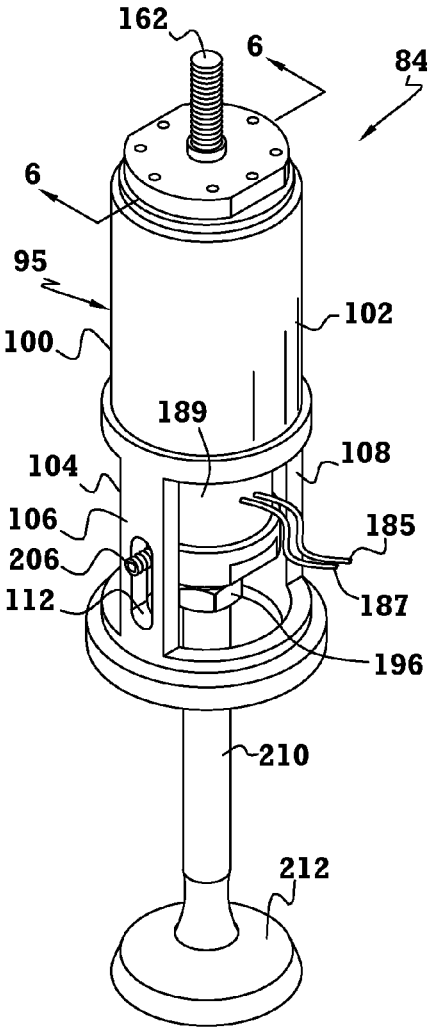
FIG. 5 is a perspective view of the assembled intake valve assembly in the closed position, with a heat sink unit removed for clarity.
Figure 5A:
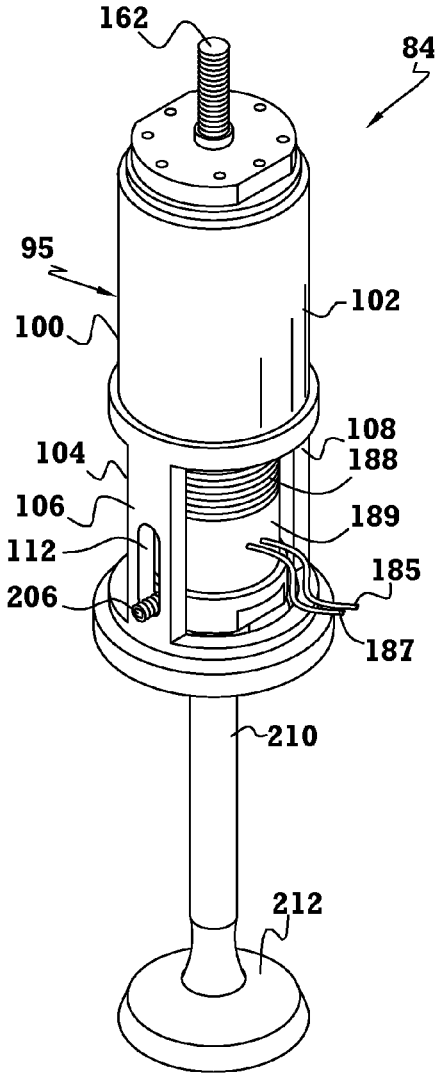
FIG. 5A is a perspective view of the assembled intake valve assembly in the open position, with the heat sink unit removed for clarity.

Referring again to FIGS. 4, 5 and 5A, the lower mounting base 190 preferably includes an upper mounting section 192 that is received in the spool 180 and a lower mounting section 194 that receives a threaded sleeve nut 196 and the valve 96. The lower mounting section 194 is preferably generally disk-shaped with a pair of diametrically opposed flats 198 (only one shown in FIG. 4) for engagement by a wrench or the like during assembly/disassembly. A threaded opening 200 extends through the lower mounting base 190 and a similarly sized threaded opening 202 extends through the sleeve nut 196. A threaded opening 204 is also formed in the lower mounting section 194 in a direction transverse to the threaded opening 200 for receiving a threaded guide pin 206. When assembled, the guide pin 206 extends through the slot 112 in the housing 95 for guiding reciprocal movement of the coil assembly 94 between open and closed positions during operation, as shown in FIGS. 5 and 5A. It will be understood that the opening 204 and guide pin need not be threaded but may be connected through other well-known connection means such as press-fitting, welding, brazing, bonding, and so on. A plurality of lower ventilation apertures 208 extend through the lower mounting base 190 to allow heated air (that may be generated by the coil assembly 94) to escape from the housing assembly 90 and into the valve cover 86 (FIGS. 1 and 2) where it can be dissipated by the ventilator fans 97.

Figure 6A:
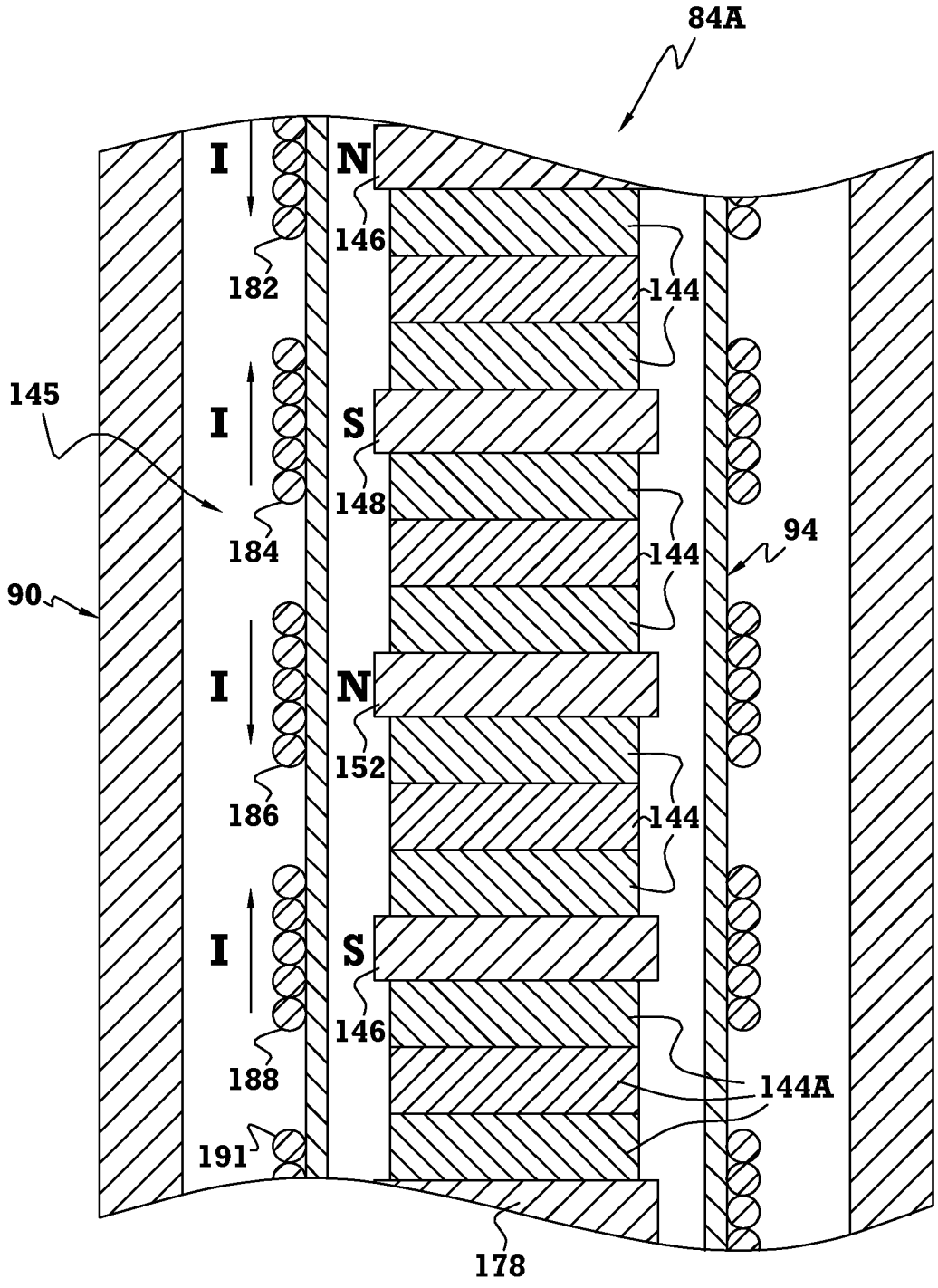
FIG. 6A is an enlarged diagrammatic sectional view of a portion of a valve assembly in accordance with a further embodiment of the invention.

Referring now to FIG. 6A, a schematic sectional view of an electronic valve assembly 84A in accordance with a further embodiment of the invention is illustrated. The valve assembly 84A is similar in construction to the intake and exhaust valve assemblies previously described, with the exception that the mounting rod 140 is eliminated and an extra stack of magnets 144A, an extra spacer 178 and an extra coil 191 are provided. The provision of the extra components effectively lengthens the permanent magnet and coil assemblies to provide additional stroke length. Accordingly, it will be understood that the number of permanent magnet stacks, the number of magnets in each stack, the number of spacers, as well as the number of coils can vary, depending on the stroke length, power requirements and so on.

Figure 7:
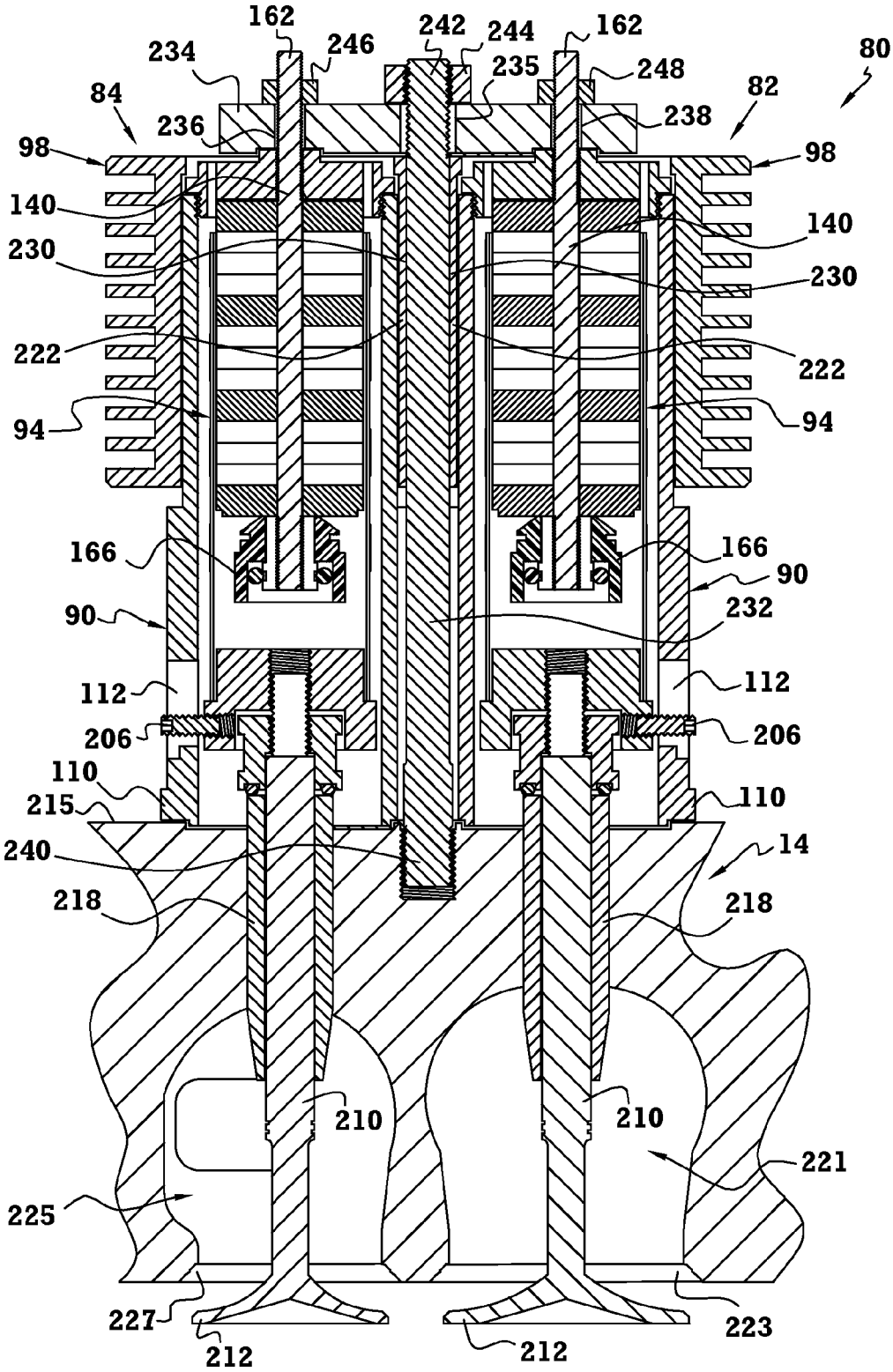
FIG. 7 is a side sectional view of the electronic valve system taken along line 7-7 of FIG. 3 showing both intake and exhaust valve assemblies with their respective valves in the open position.
Figure 11:
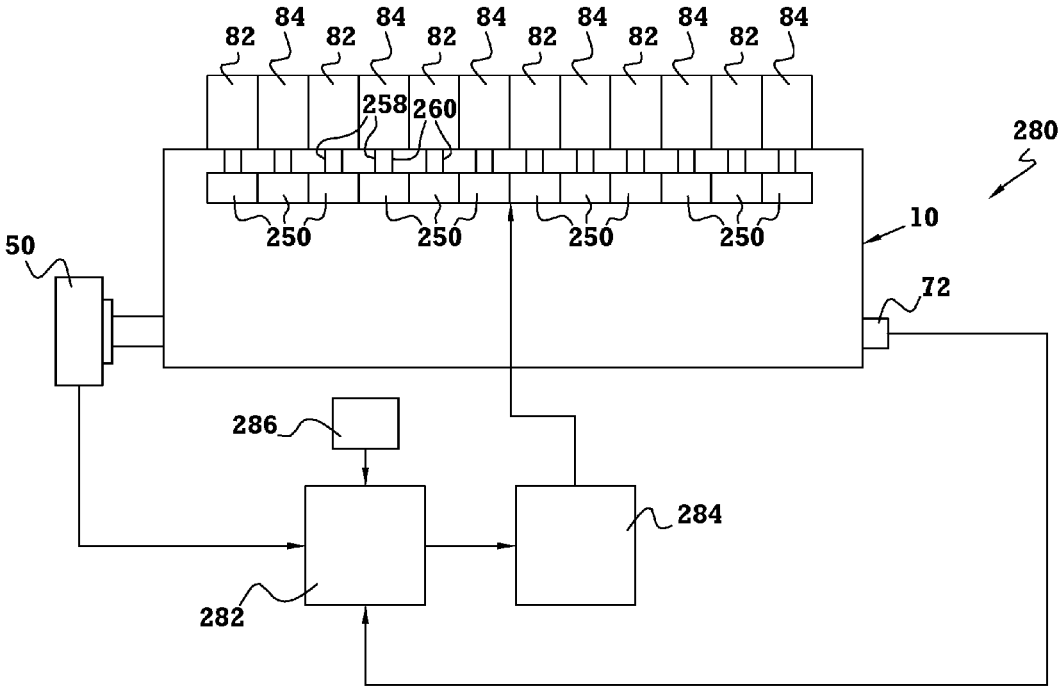
FIG. 11 is a schematic diagram of the engine and a closed loop control system therefor in accordance with the present invention.

Referring again to FIGS. 4, 5 and 5A, the valve 96 includes a valve stem 210 and a valve head 212 located at a lower end of the valve stem. The upper end of the valve stem 210 has a reduced diameter threaded portion 214 that engages the threaded openings 202 and 200 in the sleeve nut 196 and lower mounting base 190, respectively. A lower shock absorber 216, preferably in the form of a resilient O-ring, is connected to a bottom of the sleeve nut 196 and is operative to contact a valve sleeve 218 of the cylinder head 14 and cushion downward movement of the coil assembly 94 as it moves toward the lower-most or completely open position, as shown in FIG. 7. Preferably, the lower shock absorber 216 is constructed of an elastomeric material, such as Viton™ or other synthetic rubber. It will be understood that the upper and/or lower shock absorbers can be eliminated and/or replaced by varying the velocity at which the valve 96 approaches its seated or open positions through a valve control system 280 (FIG. 11).

The heat transfer unit 98 preferably includes a first generally semi-cylindrical wall portion 220 and a second generally flat wall portion 222 that intersects the first wall portion. An upper wall portion 224 has an opening 226 that is sized to receive the cap 120. A number of axially spaced curved rib sections or cooling fins 228 extend outwardly from the first wall portion 220 while a number of axially spaced flat rib sections or cooling fins 229 extend outwardly from the second wall portion 222. An axially extending groove 230 is formed in the flat wall portion 222 and associated fins 229 to accommodate a threaded mounting stud 232 (FIG. 7). The heat transfer unit 98 is preferably constructed of a thermally conductive material, such as aluminum, and extends along a substantial length of the upper section 100 of the housing 95, and thus the permanent magnet assembly 92 and the coil assembly 94 when in the closed position, to provide efficient thermal transfer during operation.

Although the intake and exhaust valve assemblies 82, 84 are similar in construction, there may be some differences as noted above. In particular, the exhaust valve assembly 84 may have a smaller valve head 212, as shown in FIGS. 7 and 8, to accommodate the smaller diameter of the exhaust port. Other differences may include a longer or shorter stroke length and thus different configurations of permanent magnet and coil assemblies. Accordingly, it will be understood that the particular configuration of one or both valve assemblies can greatly vary to accommodate a wide range of different engine types, modifications, stroke lengths, and power requirements.

Referring now to FIGS. 7 and 8, the cylinder head 14 includes an upper surface 215 on which the pairs 80 of valve assemblies 82, 84 are mounted. The cylinder head 14 also includes a primary intake port 221 with a valve seat 223 that receives the intake valve head 212, and a primary exhaust port 225 with a valve seat 227 that receives the exhaust valve head 212.

Each of the pairs 80 of valve assemblies 82, 84 are preferably secured together with a connector bar 234. The connector bar 234 has a central opening 235 that receives the threaded mounting stud 232 and spaced openings 236, 238 that receive the threaded upper ends 162 of the mounting rods 140. Each pair 80 of valve assemblies 82, 84 is in turn mounted together on the cylinder head 14 such that the flat wall portions 222 and fins 229 of the heat transfer units 98 of the intake and exhaust valve assembles face each other with their axially extending grooves 230 aligned to form a bore through which the threaded mounting stud 232 extends. A lower end 240 of the mounting stud 232 is preferably threaded into the cylinder head 14 while an upper end 242 thereof receives a threaded nut 244 for securing the pairs 80 of valve assemblies 82, 84 to the cylinder head 14. The upper ends 162 of the mounting rods 140 also receive a threaded nut 246, 248 to secure the valve assemblies 82, 84 to the connector bar 234.

As shown in FIGS. 2 and 11, a plurality of connector blocks 250 are mounted on a connector rail 252 which is in turn connected to the cylinder head 14. Each connector block 250 includes a pair of terminals 254 and 256 that are electrically connected to the leads 185 and 187, respectively, of one of the valve assemblies 82, 84. A pair of conductors 258 and 260 are in turn electrically connected to the terminals 254 and 256, respectively, of a valve control system 280 so that each valve assembly 185, 187 can be directly controlled as will be described in greater detail below.

In operation, and with particular reference to FIG. 9, due to the construction and materials of the permanent magnet assembly, coil assembly and housing, the intake and exhaust valve assemblies 82, 84 are initially in an open position (FIG. 7) before electrical power is applied to the coil assemblies. When an electrical current is applied to the coils of one of the valve assemblies 82 and 84, temporary magnetic fields generated by the coils 182 and 186 have first axial components of polarity 262 while temporary magnetic fields generated by the coils 184 and 188 have second axial components of opposite polarity 264 that intersect in the annular air gap 145 with the radial components 265 of the magnetic field circuits 266, 268 and 269 of the permanent magnet assembly 92 to move the coil assembly and thus the valve 96 (FIG. 4) upwardly toward the closed position, as shown in FIG. 8. Arrows 270 and 272 denote the directions of the magnetic field circuits generated by the permanent magnet assembly 92. Preferably, the axial and radial components of the temporary and permanent magnetic fields are perpendicular to each other.

When an electrical current is applied to the coils in the opposite direction, as shown in FIG. 10, temporary magnetic fields generated by the coils 184 and 188 have first axial components of polarity 262 while temporary magnetic fields generated by the coils 182 and 186 have second axial components of opposite polarity 264 that intersect in the annular air gap 145 with the radial components 265 of the magnetic fields of the permanent magnet assembly 92 to move the coil assembly and thus the valve 96 downwardly toward the open position, as shown in FIG. 7.

The reciprocal movement of the coil assembly 94 in the annular gap 145 together with the upper ventilation apertures 136 of the stationary cap 120, the lower ventilation apertures 208 of the lower mounting base 190 and the heat transfer unit 98 helps to reduce or eliminate heat that may be generated by the coils. One or more of the ventilator fans 97 (FIGS. 1 and 2) can be operated continuously or intermittently with or without a temperature sensor (not shown) to force cooler air across the cooling fins 228 and 229 of each valve assembly 82, 84. It should be noted that the pairs 80 of electronic valve assemblies 82, 84 as presently configured do not need lubricating oil and are sufficiently cooled to preclude additional cooling means.

A six-cylinder twelve-valve turbo diesel engine 10 was modified to include the above-described electronic valve assemblies 82 and 84, as shown in FIGS. 1 and 2, with the exemplary materials and dimensions. Surprisingly, it was found that each valve assembly can operate at 12 volts and approximately 5 to 6 amps for a total power requirement of about 840 watts for all 12 valve assemblies with the engine operating between about 800 and 3500 RPM. Almost all of the required power is used to generate the ascending and descending movement of the valves, with the exception of minimal thermal loss in the coils 182, 184, 186, and 188.

The high operating efficiency of the present invention can be attributed to reciprocating movement of the relatively light weight non-ferromagnetic material of the coil assembly, as well as the lack of magnetic hysteresis or losses due to reluctance of the materials of the present invention, as compared to the movement of relatively heavy mobile permanent magnetic core assemblies or mobile coil armature assemblies of the prior art that require much higher voltages and current to operate. Should more power be needed, such as to move larger valves, to overcome greater pressure within the cylinders, and/or to operate at higher RPM's, the increase in weight of the coil assembly 94 of the present invention would be negligible. By way of example, to quadruple the power, the diameter of the permanent magnets could be increased to 50 mm and the diameter of the coils could be increased to 52 mm, thus increasing the weight of the mobile coil assembly by about 20 grams. This feature is a great improvement over prior art mobile permanent magnet core assemblies or mobile coil armature assemblies since a notable increase in the weight of the mobile assemblies would produce a disproportionate increase in energy consumption to operate the valves.

Turning now to FIG. 11, a closed loop valve control system 280 for operating the electronic valve assemblies 82, 84 is shown in block diagram. The control system 280 preferably includes a processor, such as a microprocessor 282 or microcontroller or other processing means, a crank angle sensor 50 and a fuel injection sensor 72 connected to inputs of the microprocessor, and a valve control interface 284 connected to an output of the microprocessor. Other sensors, as represented by block 286, such as engine oil temperature, coolant temperature, oil pressure, emissions sensors, and so on, may also be connected to the microprocessor for dynamically adjusting operation of the electronic valve assemblies according to real time engine operating conditions.

Figure 12:
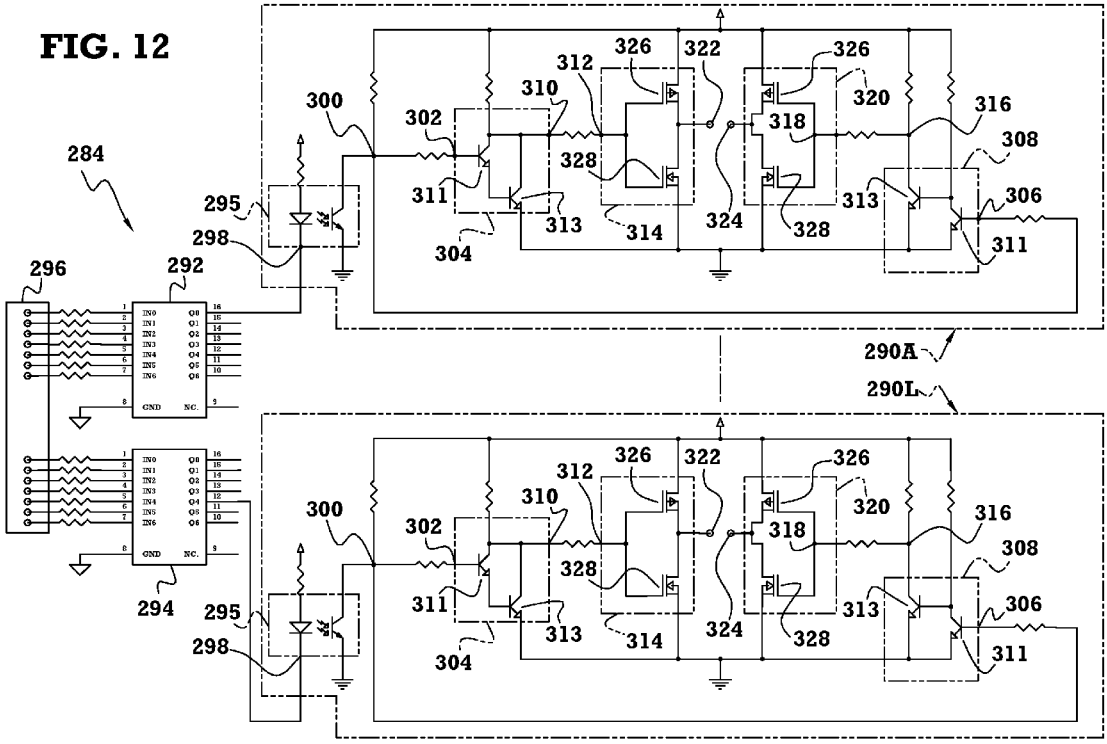
FIG. 12 is a schematic diagram of the valve control interface that forms part of the closed loop control system of the present invention.

As shown in FIG. 12, the valve control interface 284 includes a plurality of identical electrical circuits 290 for operating a corresponding number of valve assemblies. By way of example, an internal combustion engine having 12 valve assemblies will require 12 electrical circuits 290A-290L (only two circuits 290A and 290L are shown for clarity). A pair of Darlington arrays 292, 294 are electrically connected between the microprocessor 282 via cable connector 296 and each electrical circuit 290. The two arrays provide sufficient outputs (Q0-Q6 and Q0-Q4, respectively), to accommodate the twelve valve assemblies. It will be understood that more or less arrays can be used depending on the number of valve assemblies. It will be further understood that other means for interfacing between the microprocessor 282 and the circuits 290 can be provided.

Each circuit 290 preferably includes an opto-isolator 295 having an input 298 connected to one of the Darlington array outputs and an output 300 connected to the input 302 of a first transistor pair 304 and the input 306 of a second transistor pair 308 to form a transistor bridge. Each of the first and second transistor pairs 304 and 308 includes a first transistor 311 and a second transistor 313. The output 310 of the first transistor pair 304 is in turn connected to the input 312 of a first MOSFET pair 314 while the output 316 of the second transistor pair 308 is in turn connected to the input 318 of a second MOSFET pair 320. The outputs 322 and 324 of the first and second MOSFET pairs 314 and 320 are electrically connected to the leads 185 and 187, respectively, of one of the coil assemblies 94. Preferably, a first MOSFET 326 of the first and second MOSFET pairs is of the P-Channel type while a second MOSFET 328 is of the N-Channel type.

In operation, the output ports of the microcontroller 282 (FIG. 11) are configured to deliver a logical one (1) corresponding to five volts, or a logical zero (0) corresponding to zero volts. When the output of the microprocessor is at zero volts (logical zero), the opto-isolator 295 is not conductive. The first transistor pair 304 enters into saturation and the output 310 is at zero volts. The first MOSFET 326 of the first MOSFET pair 314 remains saturated and the second MOSFET 328 of the first MOSFET pair is closed. Meanwhile, the first transistor 311 of the second transistor pair 308 enters into saturation and the second transistor 313 of the second transistor pair is closed. In this state, driving voltage (12 volts in the present example) is present at the input 318 of the second MOSFET pair 320. The first MOSFET 326 of the second MOSFET pair 320 is closed and the second MOSFET 328 of the second MOSFET pair is saturated. Thus, electrical current travels through the coil assembly in one direction.

When the output of the microprocessor is at five volts (logical one), the opto-isolator 295 is conductive. The first and second transistors of the first transistor pair 304 are closed and the second MOSFET 328 of the first MOSFET pair 314 is saturated. Meanwhile, the first transistor 311 of the second transistor pair 308 is closed and the second transistor 313 of the second transistor pair is saturated. In this state, zero volts is present at the input 318 of the second MOSFET pair 320. The first MOSFET 326 of the second MOSFET pair 320 enters into saturation and the second MOSFET 328 of the second MOSFET pair is closed. Thus, electrical current travels through the coil assembly in the opposite direction.

Figure 13:
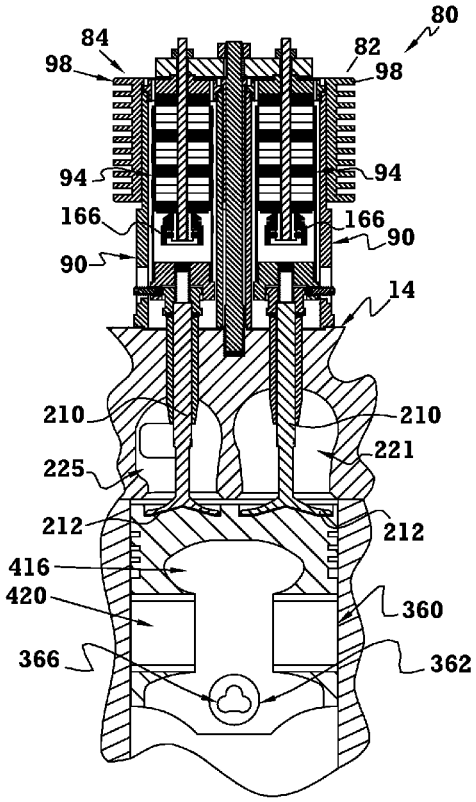
FIG. 13 is a side sectional view of the engine and electronic valve assemblies similar to FIG. 6 with the electronic valve assemblies in a first position.

When the ignition is turned off, a relay (not shown) interrupts the flow of electrical power to the electrical circuits 290A to 290L. In this state, all of the valves will open, as shown in FIG. 13 and remain in the open position until the motor 30 is operated. When the ignition is turned on and the starter motor 30 (FIG. 1) is actuated to turn the crankshaft 55 (FIG. 21), the output of the crank angle sensor 50 (FIGS. 1 and 11) sends first and second signals to the microprocessor 282 indicative of a completed revolution and an angular position, respectively, of the crankshaft 55. The fuel injection sensor 72 (FIGS. 1 and 11) also sends a signal to the microprocessor 282 indicative of the rotational angle of the injection pump shaft (not shown). Since the crankshaft 55 of the engine 10 of the exemplary embodiment rotates twice for every rotation of an equivalent camshaft, the provision of two separate sensors ensures that the starting position of each valve 96 is correctly determined. Once the engine 10 is in operation, the sensor 72 is no longer needed. The revolution and an angular position signals of the crank angle sensor 50 can then be used to monitor revolutions per minute (RPM) and the particular rotational position of the crankshaft 55 to dynamically adjust timing, valve opening and closing, valve position and duration at a particular position, the speed of valve movement including valve ramp-up and ramp-down, and so on. It has been found that a crank angle sensor with 360 degrees of resolution provides a high degree of accuracy and flexibility for dynamically adjusting valve timing and thus engine performance. It will be understood that sensors with higher or lower resolution or other sensors or means for determining the correct starting position and/or running condition can alternatively be used. It will be further understood that the control system 280 is not limited to the particular circuitry and components shown and described, but may be replaced by other control means.

Figure 14:
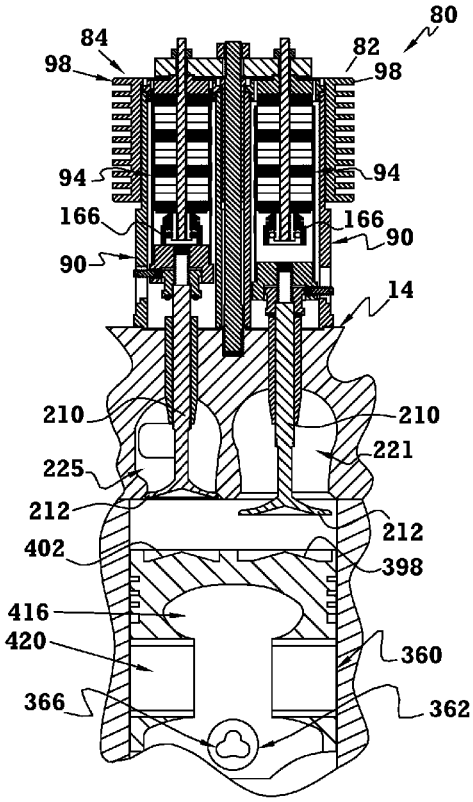
FIG. 14 is a sectional view similar to FIG. 13 and showing the electronic valve assemblies in a second position.
Figure 15:
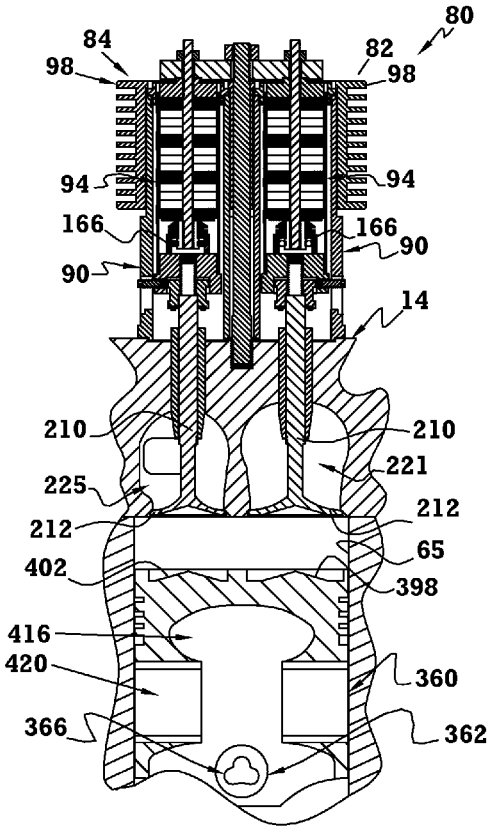
FIG. 15 is a sectional view similar to FIG. 13 and showing the valve assemblies in a third position.
Figure 16:
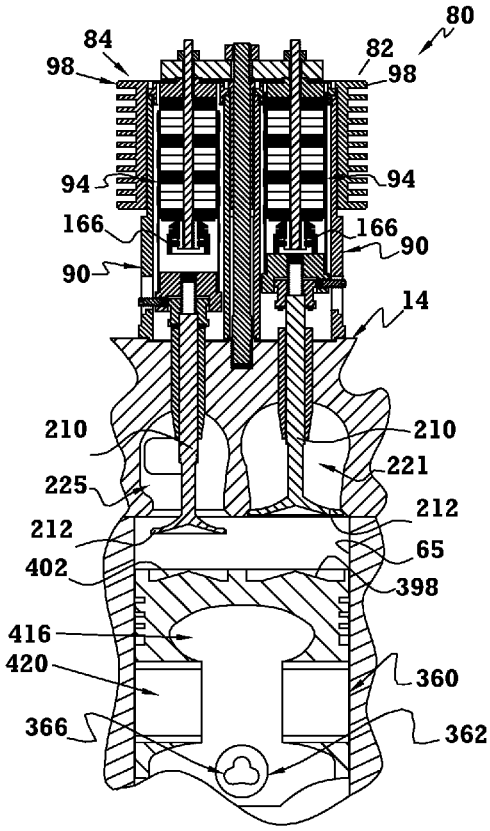
FIG. 16 is a sectional view similar to FIG. 13 and showing the valve assemblies in a fourth position.

Once the starting position of each valve is determined, which will typically be within one revolution of engine cranking, the valve assemblies can be operated by the control system 280 for dynamically positioning the valves at their proper starting position to begin operating. By way of example, for a four-cycle four-stroke engine, one of the cylinders 65 may be in a fuel intake cycle wherein the intake valve assembly 82 is open and the exhaust valve assembly 84 is closed, as shown in FIG. 14. Likewise, another cylinder may be in the compression or expansion cycles wherein the intake and exhaust valve assemblies are both closed, as shown in FIG. 15. Finally, yet another cylinder may be in the exhaust cycle wherein the intake valve assembly 82 is closed and the exhaust valve assembly 84 is open, as shown in FIG. 16. The intake and exhaust valves of all cylinders 65 will then continue to operate with precise sequential alternating opening and closing movements under control of the microprocessor 282 (FIG. 11) and related circuitry 284 as described above.

Figure 38:
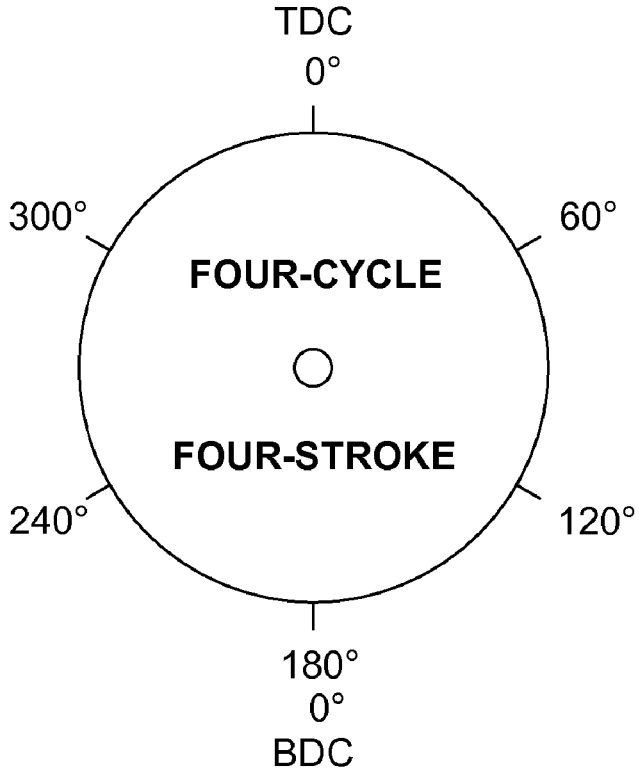
FIG. 38 is a schematic view of the timing for a four-stroke six-cylinder symmetric engine.
Figures 39, 40:
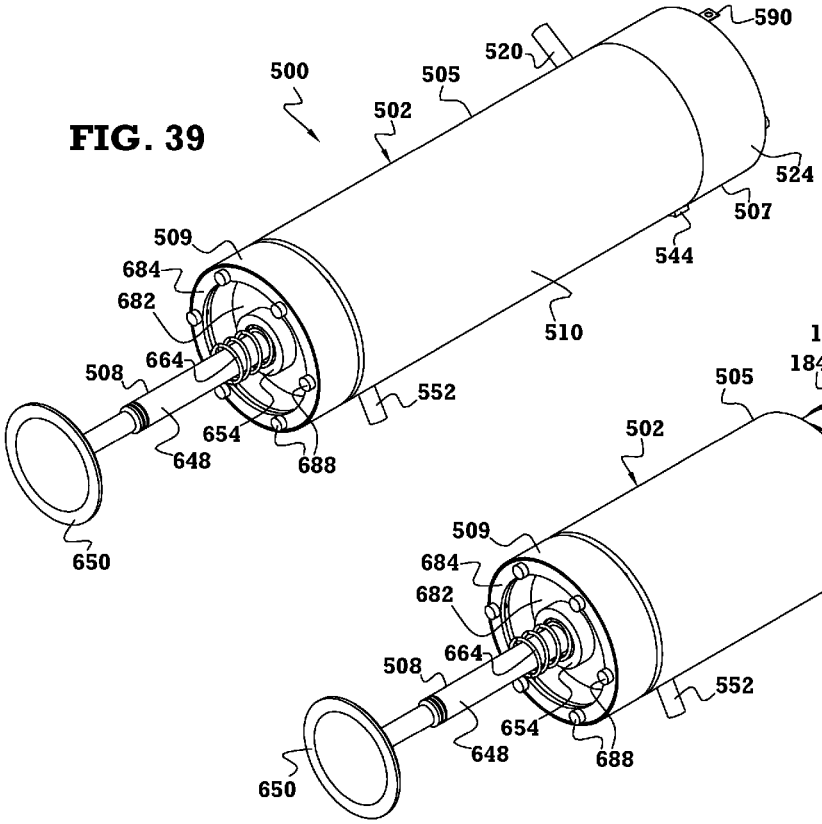
FIG. 39 is a bottom isometric view of an electronic valve assembly in accordance with a further embodiment of the invention.
FIG. 40 is a view similar to FIG. 39 with a portion of an outer housing removed to reveal a coolant passage and a portion of the coil assembly.
Figure 41:
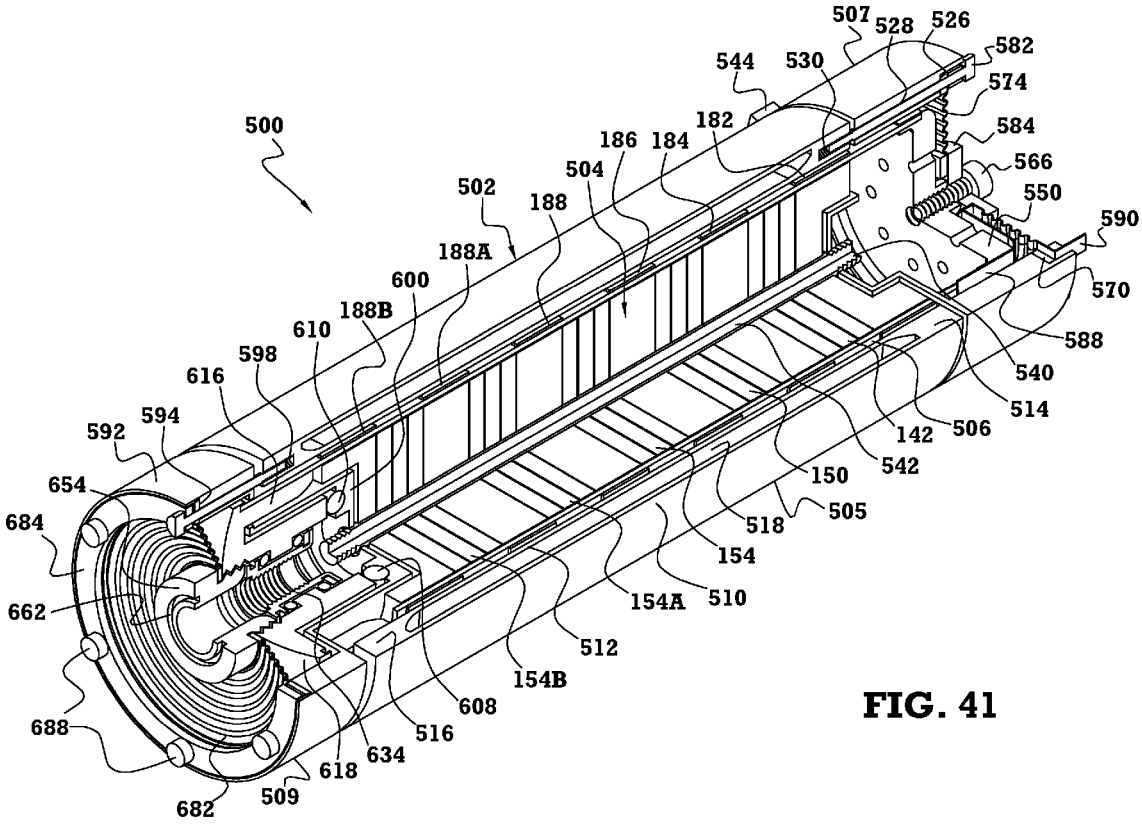
FIG. 41 is an enlarged longitudinal cut-away bottom isometric view of the valve assembly of FIG. 39 with the valve stem removed for clarity.
Figure 42:
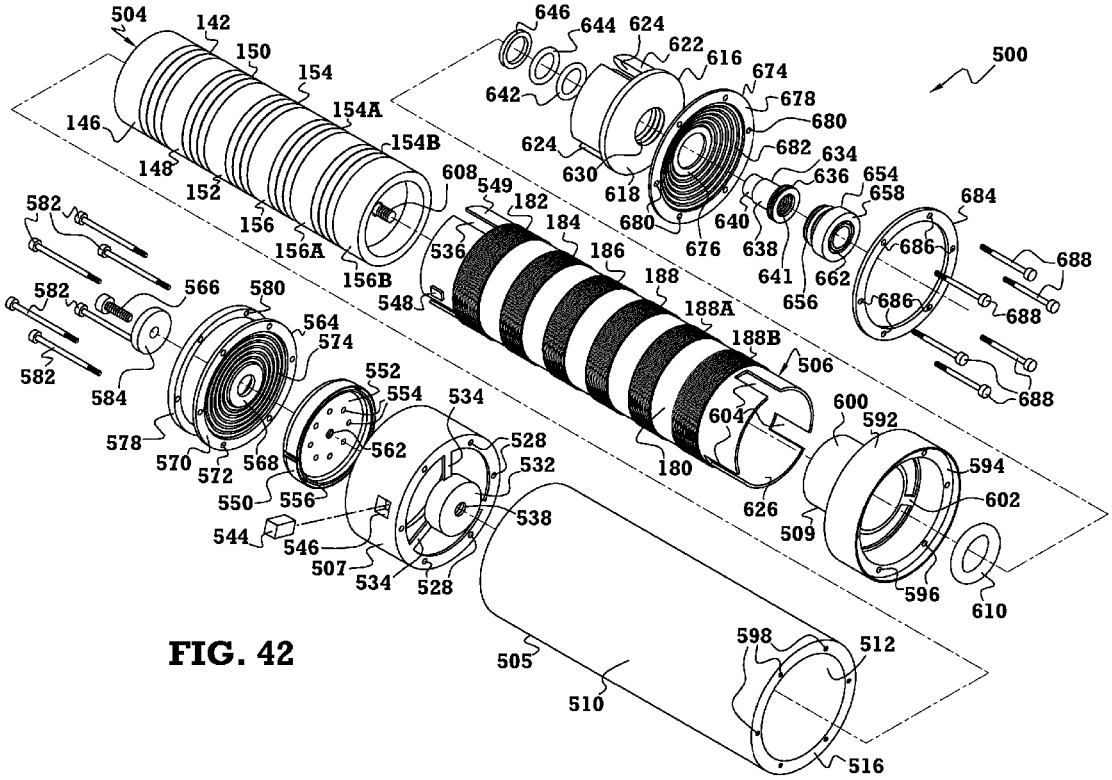
FIG. 42 is a top isometric exploded view of the valve assembly of FIG. 39.
Figure 43:
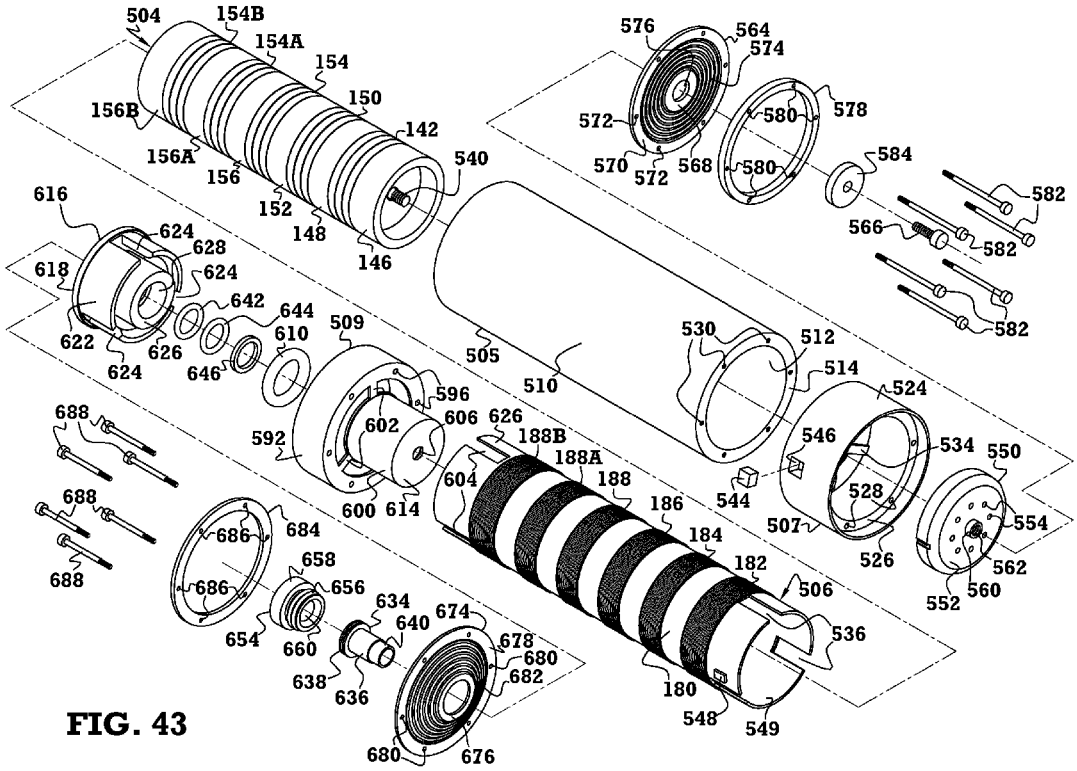
FIG. 43 is a bottom isometric exploded view of the valve assembly of FIG. 39.

In accordance with one exemplary embodiment of the invention, and referring to FIG. 38, a valve timing diagram is shown for a six cylinder four-cycle engine having a symmetric crankshaft. The diagram shows the explosion sequence in each cylinder during first and second rotations of the crankshaft. During the first rotation, combustion occurs in the first, fifth and third cylinders at 0° top dead center (TDC), 120°, and 240°, respectively. During the second rotation, combustion occurs in the sixth, second and fourth cylinders at 0° TDC, 120°, and 240°, respectively. All other functions associated with the cylinders, such as fuel injection and valve opening and closing can be adjusted in relation to the combustion cycle to obtain various operational effects. In accordance with the present invention, each valve can be controlled independently of all other valves through the closed-loop control system 280 or the like to vary valve timing, overlap, lift, ramp speed, dynamic engine braking, cylinder deactivation wherein the valves are completely open (deactivated) for better fuel economy when less torque is required, and so on.

Figure 17A:
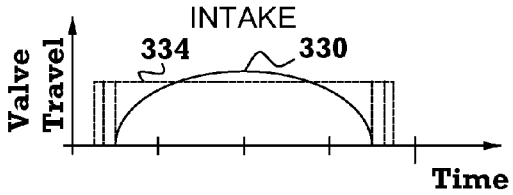
FIGS. 17A-20B show various exemplary graphs that demonstrate various combinations of valve travel versus time for the intake and exhaust valve assemblies as well as a prior art mechanical valve arrangement.
Figure 17B:
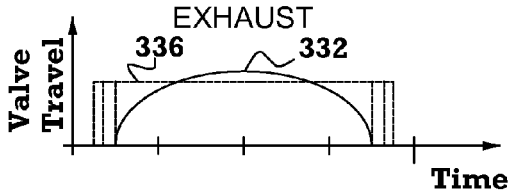

FIGS. 17A-20B show various exemplary traces of variable valve lift or position versus time (dashed lines) for the electronic intake and exhaust valves of the present invention with a superimposed prior art trace 330 and 332 of valve lift versus time for cam-driven intake and exhaust valves (solid lines), respectively. FIG. 17A shows a trace 334 for an intake valve assembly 82 with variable valve opening and closing times, and thus variable time intervals at which the valve remains opened and closed. Likewise, FIG. 17B shows a trace 336 for an exhaust valve assembly 84 with variable valve opening and closing times and time intervals. As shown, the open position of the intake and exhaust valves is less than the open position of the prior art intake and exhaust valves. It will be understood however, that the open position can be the same or greater (i.e. more open) than the prior art valves. Although three opening and three closing times are shown, it will be understood that the particular times for opening and closing as well as the open and closed durations are infinitely variable. Since the timing of both the intake and exhaust valve assemblies can be adjusted, it is possible to overlap their opening and closing cycles to obtain particular engine performance characteristics.

Figure 18A:
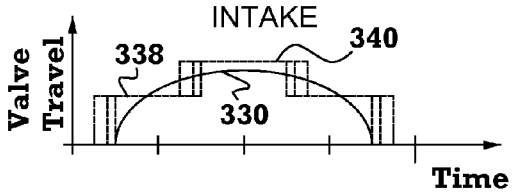
Figure 18B:
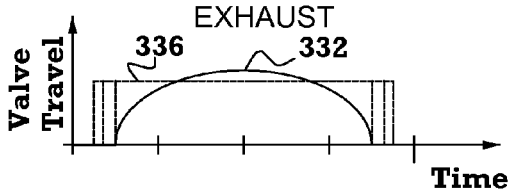

FIG. 18A shows a trace 338 for an intake valve assembly 82 with variable valve opening and closing times, and a stepped portion 340 with variable step-up and step-down times. It may be desirous under certain engine operating or performance conditions to partially open the intake valve to a first position during a first time interval then fully opening the intake valve to a second position for a second time interval, then partially closing the intake valve to a third position for a third time interval before fully closing the intake valve. As shown, the stepped portion 340 is greater than the prior art trace 330, signifying that the intake valve of the present invention can be positioned at a more open position than the prior art intake valve. This is at least due in part to a modification of the piston which allows a longer stroke length without the danger of the piston and valve coming into contact with each other, as will be described in greater detail below. Although FIG. 18A shows the intake valve partially opened and then closed to about two-thirds of the fully open position for the first and third time intervals, it will be understood that the intermediate valve positions and time intervals are infinitely adjustable. The valve can be held in the various step positions as well as in the open and closed positions by controlling the amount of current through the coil so that the weight of the coil assembly and valve are balanced at the desired position, taking into account any pressure that may be exerted on the valve, such as during combustion, intake, exhaust, and so on. Alternatively, the valve may be maintained at a desired position by pulsing the full current for a particular duty cycle that depends on the weight of the coil assembly and valve as well as any pressure that may be exerted on the valve. FIG. 18B is similar to FIG. 17B and illustrates the independent adjustability of the exhaust valve. It will be understood that the amount of lift and duration of the exhaust valve can also be adjusted in a manner similar to FIG. 18A.

Figure 19A:
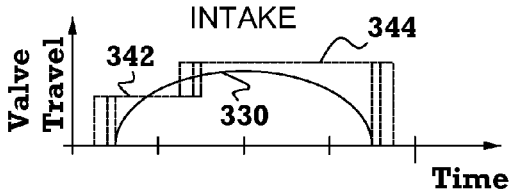
Figure 19B:
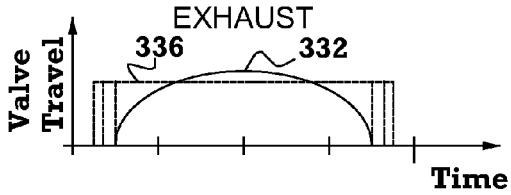

FIG. 19A shows a trace 342 for an intake valve assembly 82 with variable valve opening and closing times, and a stepped portion 344 with variable step-up times. It may be desirous under certain engine operating or performance conditions to partially open the intake valve to a first position during a first time interval then fully opening the intake valve for a second time interval before finally closing the intake valve. Although FIG. 19A shows the intake valve partially opened to about two-thirds of the fully open position for the first time interval, it will be understood that the intermediate valve position and time intervals are infinitely adjustable. FIG. 19B is similar to FIG. 17B and illustrates the independent adjustability of the exhaust valve. It will be understood that the lift and duration of the exhaust valve can also be adjusted in a manner similar to FIG. 19A.

Figure 20A:
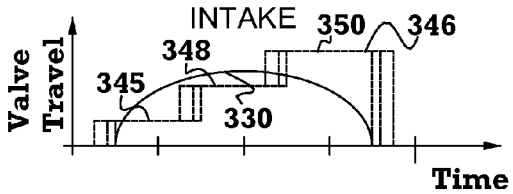
Figure 20B:
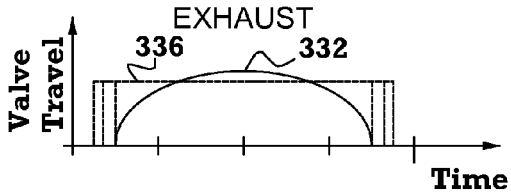

FIG. 20A shows a trace 346 for an intake valve assembly 82 with variable valve opening and closing times, a first stepped portion 345 with first variable step-up times, a second stepped portion 348 with second variable step-up times, and a third stepped portion 350 with third variable step-up times. It may be desirous under certain engine operating or performance conditions to partially open the intake valve to a first position (first step portion) during a first time interval, opening the valve further to a second position (second step portion) during a second time interval, then fully opening the intake valve (third step portion) for a third time interval before finally closing the intake valve. Although FIG. 20A shows the first step portion at approximately one-third and the second step portion at approximately two-thirds of the fully open position, it will be understood that the intermediate valve positions and time intervals are infinitely adjustable. FIG. 20B is similar to FIG. 17B and illustrates the independent adjustability of the exhaust valve assembly 84. It will be understood that the lift and duration of the exhaust valve can also be adjusted in a manner similar to FIG. 20A.

Accordingly, the system of the present invention enables the dynamic change of valve opening and closing time, valve open and closed durations, as well as valve lift or position for predetermined time intervals or durations based on real time engine conditions. When compared to the prior art fixed trace 330, the system of the present invention offers much greater flexibility. Since each intake and exhaust valve assembly is independently controlled, engine operation can be adjusted over a wide range to suit a variety of different engine conditions, performance characteristics, and operating modes. In addition, each valve can be tailored to its particular cylinder and port of the intake and exhaust manifolds. Combustion control is a function in part of the swirl of incoming air, i.e. the pattern and velocities of the air entering the cylinder across the horizontal and vertical profile of the combustion chamber. That pattern of flow is influenced by the shape of the intake manifold upstream from the valve port, the details of the port itself, and the length of the run from the port back to the inlet of the air into the intake manifold, all subject to packaging, design, and manufacturability constraints. This is difficult and exacting design and manufacturing work and the flow/swirl usually varies between cylinders more than theory would like. Thus, the ability to vary the valve lift/timing curve cylinder by cylinder as a function of RPM gives the engine designer another tool toward optimizing air patterns and swirl in each cylinder to optimize power, economy, and emissions.

Advantageously, it has been found that by electronically controlling the opening and closing times of the intake and exhaust valves together with precisely controlling fuel injection, high expansion ratios are maintained while compression temperature is reduced to thereby significantly reduce emissions, especially in turbocharged diesel engines. One such technique is disclosed in U.S. Pat. No. 6,651,618 to Coleman et al. and U.S. Pat. No. 6,688,280 to Weber et al., the disclosures of which are herein incorporated by reference.

Figure 21:
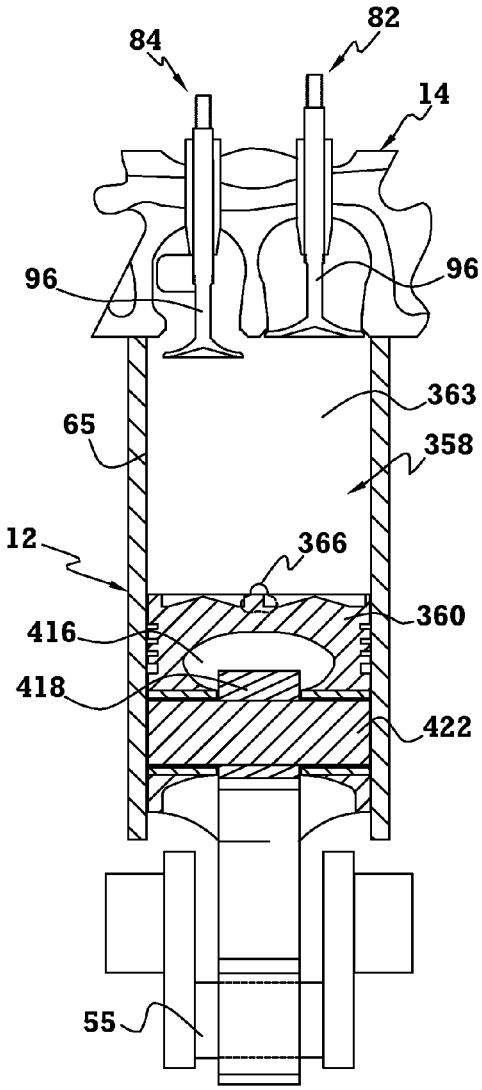
FIG. 21 is a side sectional view of an engine cylinder with the piston head in a lower position to reveal a secondary exhaust port in the cylinder wall in accordance with the present invention.
Figure 23:
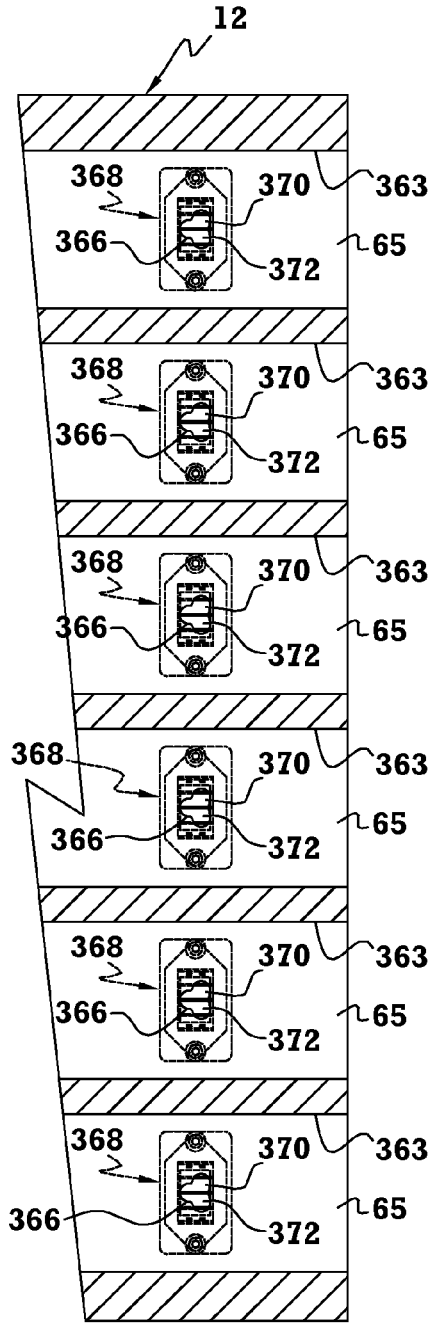
FIG. 23 is a sectional view of the engine block taken along line 23-23 of FIG. 22.

Referring now to FIGS. 21, 22 and 23, the engine block 12 includes a plurality of cylinders 65 and a piston head 360 mounted for reciprocal movement within each cylinder. Each cylinder 65 together with its related piston head 360 and cylinder head 14 define a combustion chamber 358. A secondary exhaust port 366 is formed in a wall 363 of the cylinder 65. A conduit 362 extends through the engine block 12 between the secondary exhaust port 366 and a side wall 364 of the engine block 12. Preferably, each secondary exhaust port 366 is trilobular in shape. However, it will be understood that other shapes, such as circular, oval, triangular, rectangular, and so on, can be used.

A secondary exhaust valve 368 is mounted in each secondary exhaust port 366 and includes a pair of flaps 370, 372 that are normally biased together in a closed position and forced apart when subject to exhaust pressure from the cylinder 65. A pair of stop members 374, 376 are located on either side of the flaps 370, 372 to limit the amount of flap travel.

With additional reference to FIGS. 24-27, the secondary exhaust port 366 is preferably located in the cylinder wall 363 at a predetermined height of between about 48 and 56 degrees before bottom dead center (BDC). During the expansion cycle, the piston head 360 descends to the BDC position (FIGS. 24 and 25) to uncover the secondary exhaust port 366, causing a rapid relief of combustion gas pressure and temperature. As the piston begins to rise during the exhaust cycle, the exhaust valve opens to complete the exhaust cycle to relieve any remaining pressure and creating an optimum working temperature for the intake cycle. It has been found that approximately 60% of the residual combustion pressure, temperature and gases can be removed through the secondary exhaust port to significantly alleviate the exhaust cycle. Since the pressure in the cylinder can be reduced prior to opening the exhaust valve, less electrical power will be needed to initially open the exhaust valve, resulting in an overall increase in operating efficiency.

A secondary exhaust manifold 378 is connected to the side wall 364 of the engine block 12 through fasteners 380, such as threaded bolts or the like. The secondary exhaust manifold 378 preferably encompasses the secondary exhaust valves 368 to receive expelled exhaust gases from the cylinders 65. An opening 382 is preferably centrally located in the secondary exhaust manifold 378 and is in fluid communication with the auxiliary exhaust conduit 35 (FIG. 2) where it can be delivered to the intake manifold 31 (FIG. 2) to allow a metered amount of exhaust via an EGR valve (not shown) to flow back into the engine and/or to atmosphere, thereby reducing combustion temperatures and controlling the formation of oxides of nitrogen, etc.

Figure 26:
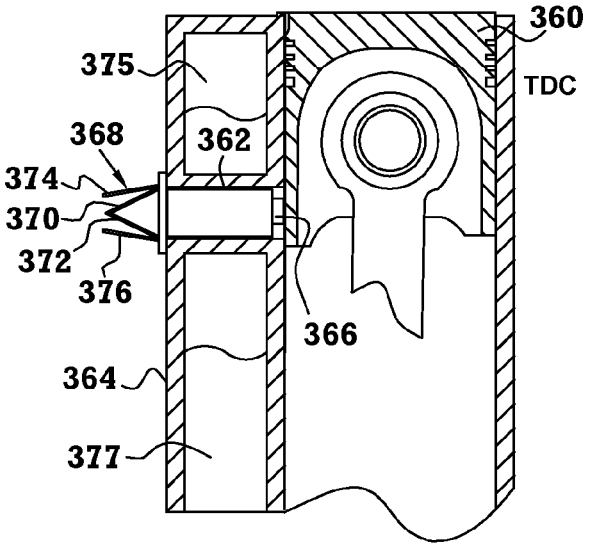
FIG. 26 is a front sectional view of the engine cylinder with the piston head in an upper position.
Figure 27:
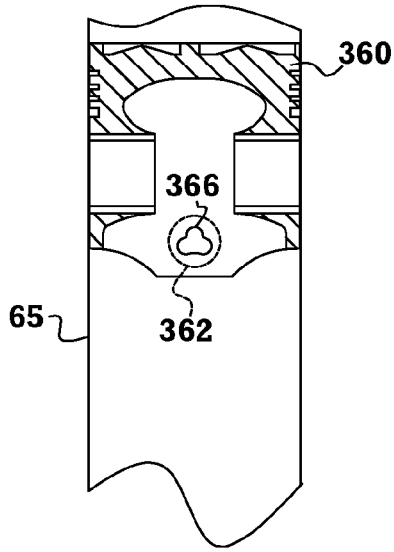
FIG. 27 is a side sectional view of the engine cylinder with the piston head in the upper position.

As shown in FIGS. 26 and 27, as the piston head 360 travels upwardly to complete the cycle, the secondary exhaust port 366 will be blocked by the piston head. During the intake cycle, the secondary exhaust port 366 is again exposed while the valve 96 of the intake valve assembly 82 is opened, causing purging of the combustion chamber 358 by the inflow of intake air. In this manner, the combustion chamber 358 exhibits an ideal compression rise during the compression cycle, whether the intake air is turbocharged or atmospheric.

Figure 24:
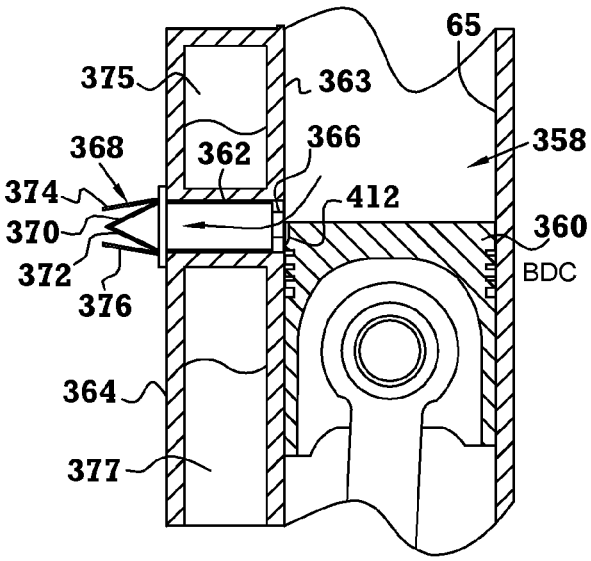
FIG. 24 is a front sectional view of the engine cylinder with the piston head in the lower position.
Figure 25:
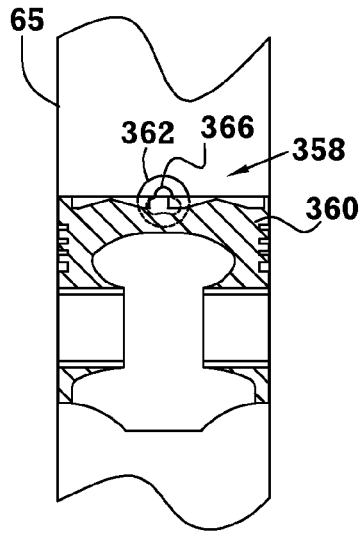
FIG. 25 is a side sectional view of the engine cylinder with the piston head in the lower position.

As shown in FIGS. 24 and 26, the side wall 364 includes pockets 375, 377 that surround the secondary exhaust port 366. The pockets 375, 377 are filled with coolant to cool exhaust gases passing through the exhaust port for recovery by the EGR valve (not shown).

Although it is preferable that the electronic valve assemblies 82, 84 be used in conjunction with the secondary relief port and its attendant advantages, it will be understood that the secondary relief port can be used with cam or fluid driven or assisted valve assemblies or the like.

Figure 21A:
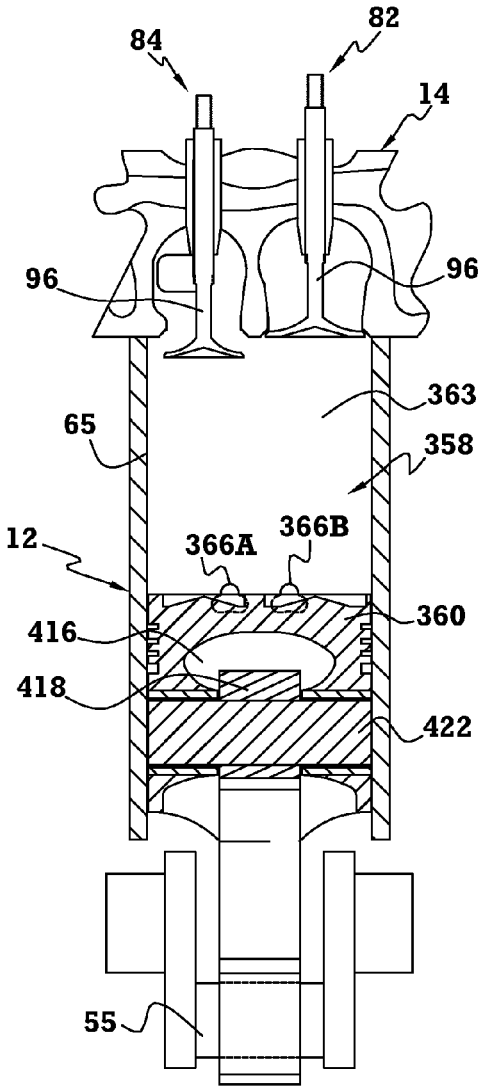
FIG. 21A is a view similar to FIG. 21 showing a pair of secondary exhaust ports in the cylinder wall in accordance with a further embodiment of the invention.

Although it has been found that a single secondary exhaust port 366 performs well, it may be desirable to provide a larger secondary exhaust port or two or more secondary exhaust ports, such as shown in FIG. 21A, wherein a pair of secondary exhaust ports 366A and 366B are formed in the cylinder wall 363. The use of two or more exhaust ports may be needed, for example, with larger cylinders and/or engines operating at higher RPM's, or when it is desirous to purge the cylinders quicker or more efficiently than with a single secondary exhaust port.

Figure 28:
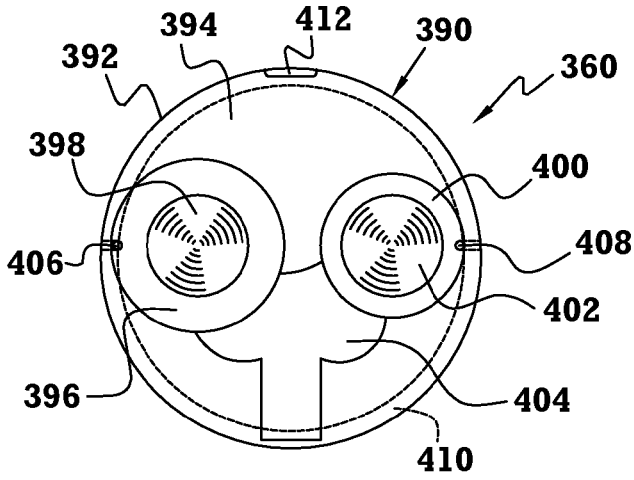
FIG. 28 is a top plan view of a piston head that forms part of the inventive internal combustion engine of FIGS. 1 and 2.
Figure 29:
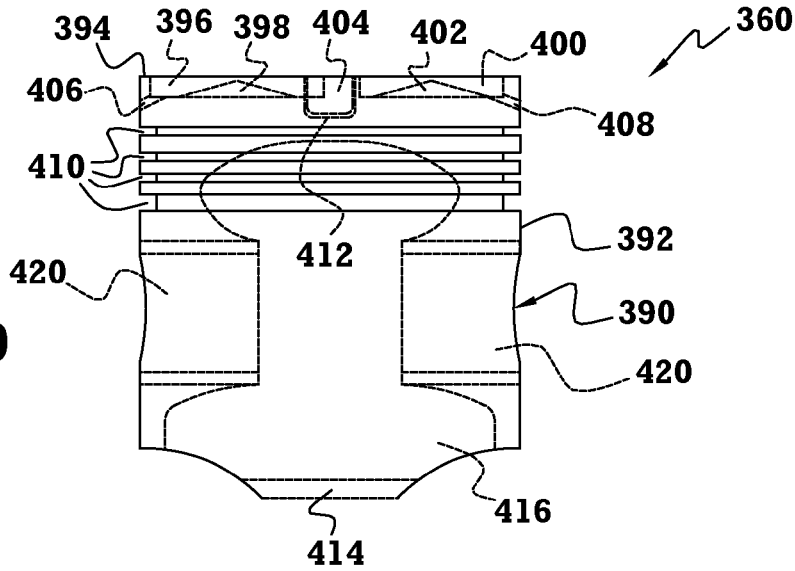
FIG. 29 is a side elevational view of the piston head.
Figure 30:
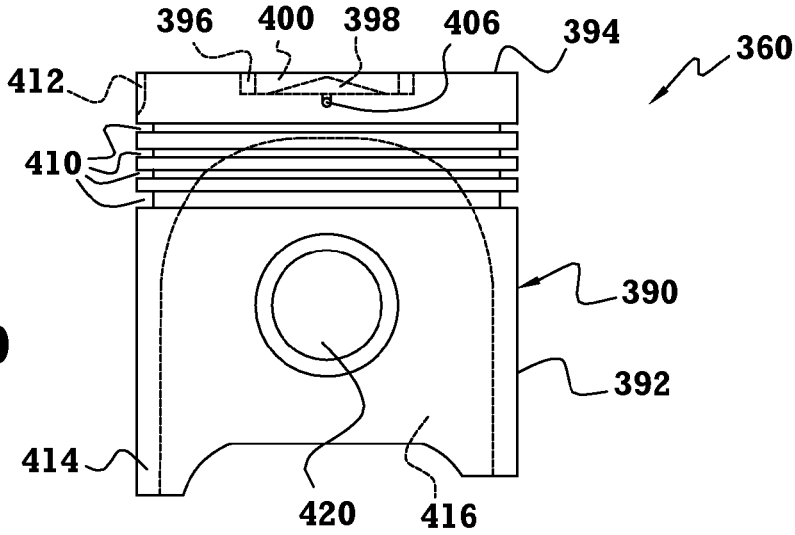
FIG. 30 is a front elevational view of the piston head.

Referring now to FIGS. 28-30, the piston head 360 in accordance with the present invention includes a piston body 390 with a generally circular top wall 394 and a generally cylindrical side wall 392 that extends downwardly from the top wall. The top wall 394 includes a first depression 396 with a first conical projection 398 that complements the profile of the valve head 212 (FIG. 13) of the intake valve assembly 82. A second depression 400 with a second conical projection 402 that complements the profile of the valve head 212 of the exhaust valve assembly 84 (FIG. 13) is also formed in the top wall 394. A third depression 404 may also be formed in the top wall 394 for swirling the air-fuel mixture prior to combustion. Calibrated orifices 406 and 408 extend from the first and second depressions 396 and 400, respectively, and into the side wall 392. The orifices preferably extend at an angle of approximately 45 degrees and open at the side wall 392 above the piston ring grooves 410 so that by-products of combustion that may collect in the depressions can be purged during upward movement of the piston head 394. A notch 412 is formed at the intersection of the top wall 394 and side wall 392. As shown in FIG. 24, the notch 412 is in alignment with the secondary exhaust port 366 when the piston head 360 is in the BDC position for expelling exhaust gases from the cylinder 65. The side wall 392 has an elongated skirt 414 to cover the secondary exhaust port 366 when the piston head 360 is in the top dead center (TDC) position to prevent the outflow of oil vapor from the crankcase (FIG. 13). A cavity 416 is formed in the piston body 390 for receiving a connecting rod 418 (FIG. 21). A bore 420 extends through the piston body 390 and intersects the cavity 416. A pin 422 (FIG. 21) is positioned within the bore 420 and extends through the cavity and connecting rod 418 to enable rotational movement of the connecting rod with respect to the piston head 360 in a well-known manner. It will be understood that the piston head 360 may be formed without the clearance depressions for the intake and exhaust valve assemblies if no interference occurs between the piston head at TDC and the valve assemblies in the fully open position. Moreover, the piston head may be formed without the notch 412 when the secondary exhaust port 366 can alternatively be exposed.

Figure 31:
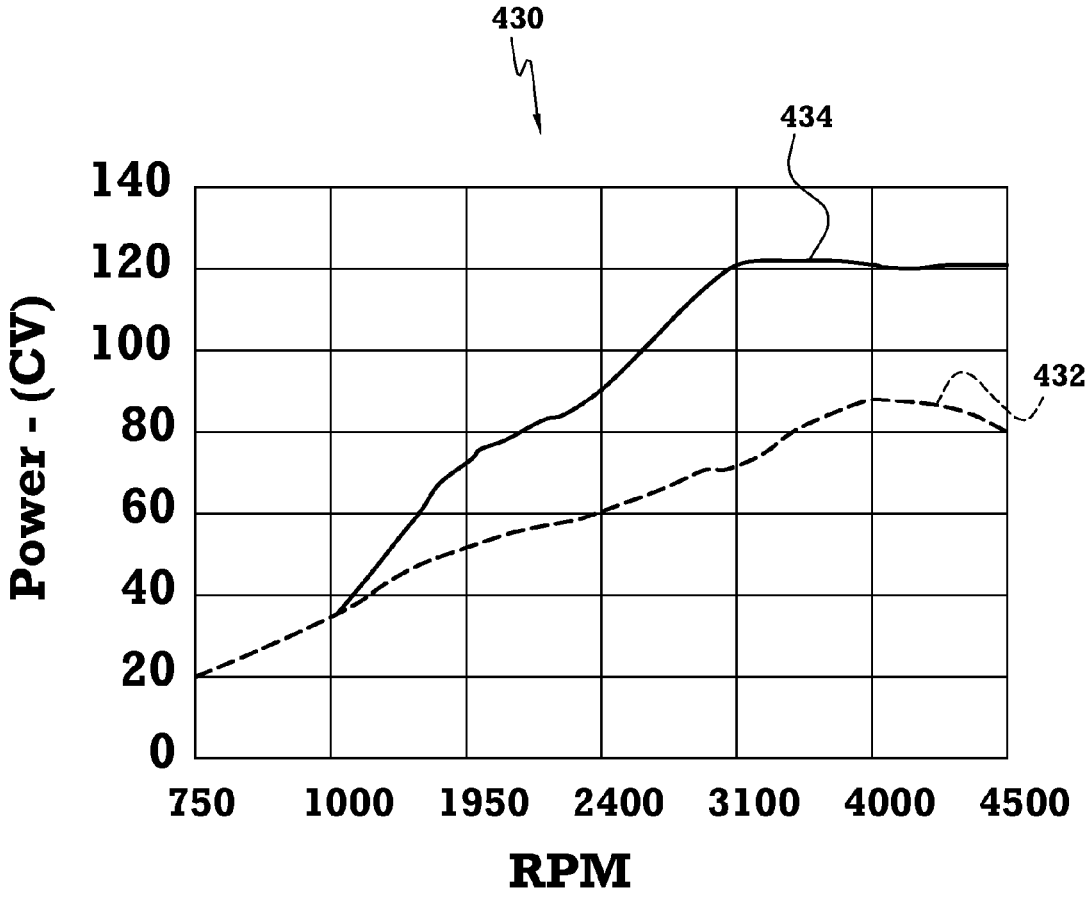
FIG. 31 is a chart comparing power output per RPM between a modified engine in accordance with the present invention and a prior art unmodified engine.

FIG. 31 shows a chart 430 comparing power output per RPM between a modified turbo-charged six-cylinder diesel engine 10 in accordance with the above-described preferred embodiment and a prior art unmodified turbo-charged six-cylinder diesel engine with cam-controlled intake and exhaust valves. Trace 432 (dashed line) is representative of the prior art engine and shows a peak power of about 90 cheval vapeur (CV) or approximately 89 horsepower (HP) that is reached at about 4,000 RPM. In contrast, trace 434 is representative of the engine 10 in accordance with the exemplary embodiment of the present invention as described above with electronic valve assemblies having the exemplary materials and sizes and modifications to the engine block and piston head. As shown, the modified engine 10 in accordance with the present invention reaches a higher power output of approximately 120 CV (118 HP) at about 3100 RPM, resulting in a significant power increase of approximately 33% at about 900 RPM's less than the prior art unmodified engine, thereby lowering fuel consumption and extending the useful life of the engine.

In accordance with a further embodiment of the invention, as schematically shown in FIGS. 32-38, the great range of operational flexibility of the engine 10 afforded by the electronic intake and exhaust valve assemblies 82, 84 (FIGS. 7 and 8) together with the closed loop valve control system 280 (FIG. 11) and the secondary exhaust port 366 (FIGS. 21 and 21A) provides for a system 440 that, together with additional modifications, can be dynamically converted or switched from a four-cycle four-stroke engine to a two-cycle four-stroke engine and back again.

Figure 32:
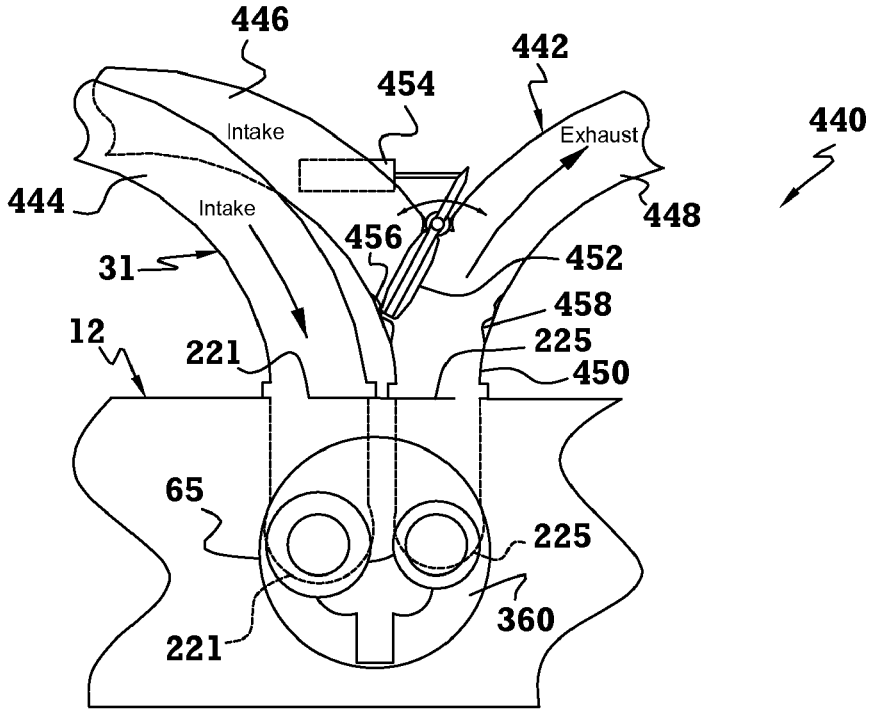
FIG. 32 is a top plan schematic view of an engine head and intake and exhaust manifolds arranged in a system for converting a four-cycle engine to a two-cycle engine according to the present invention with a diverter valve in a first position for operation as a four-cycle engine.
Figure 33:
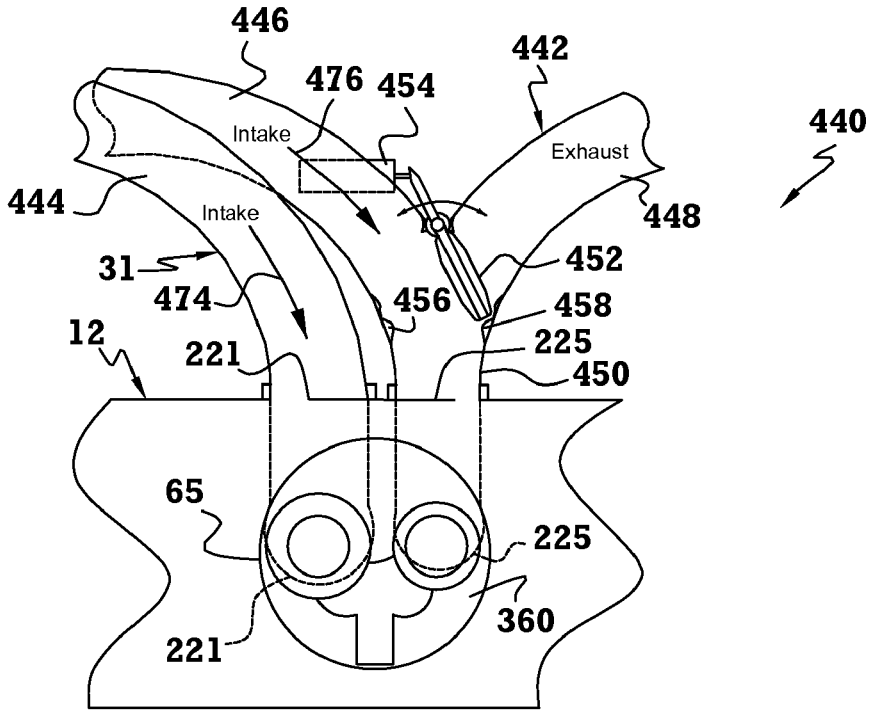
FIG. 33 is a view similar to FIG. 32 with the diverter valve in a second position for operation as a two-cycle four-stroke engine.

With particular reference now to FIGS. 32 and 33, the system 440 includes the intake manifold 31 connected to the primary intake port 221 and an exhaust manifold 442 connected to the primary exhaust port 225. The intake manifold 31 includes a primary intake conduit 444. The exhaust manifold 442 includes a base conduit 450 extending from the primary exhaust port 225 and a secondary intake conduit 446 and exhaust conduit 448 extending from the base conduit 450. A diverter valve 452 is positioned between the secondary intake conduit 446 and exhaust conduit 448 for alternately opening one conduit and closing the other conduit. Valve seats 456 and 458 are positioned on opposite sides of the base conduit 450 for receiving the diverter valve 452 in the four-cycle and two-cycle operating positions. The position of the diverter valve 452 is preferably electrically controlled by an actuator, such as solenoid 454, between the four-cycle position as shown in FIG. 32 and the two-cycle position as shown in FIG. 33. It will be understood that other actuating means can be used, such as linear or rotary actuators, manual actuators using cables or the like, and so on.

Figure 34:
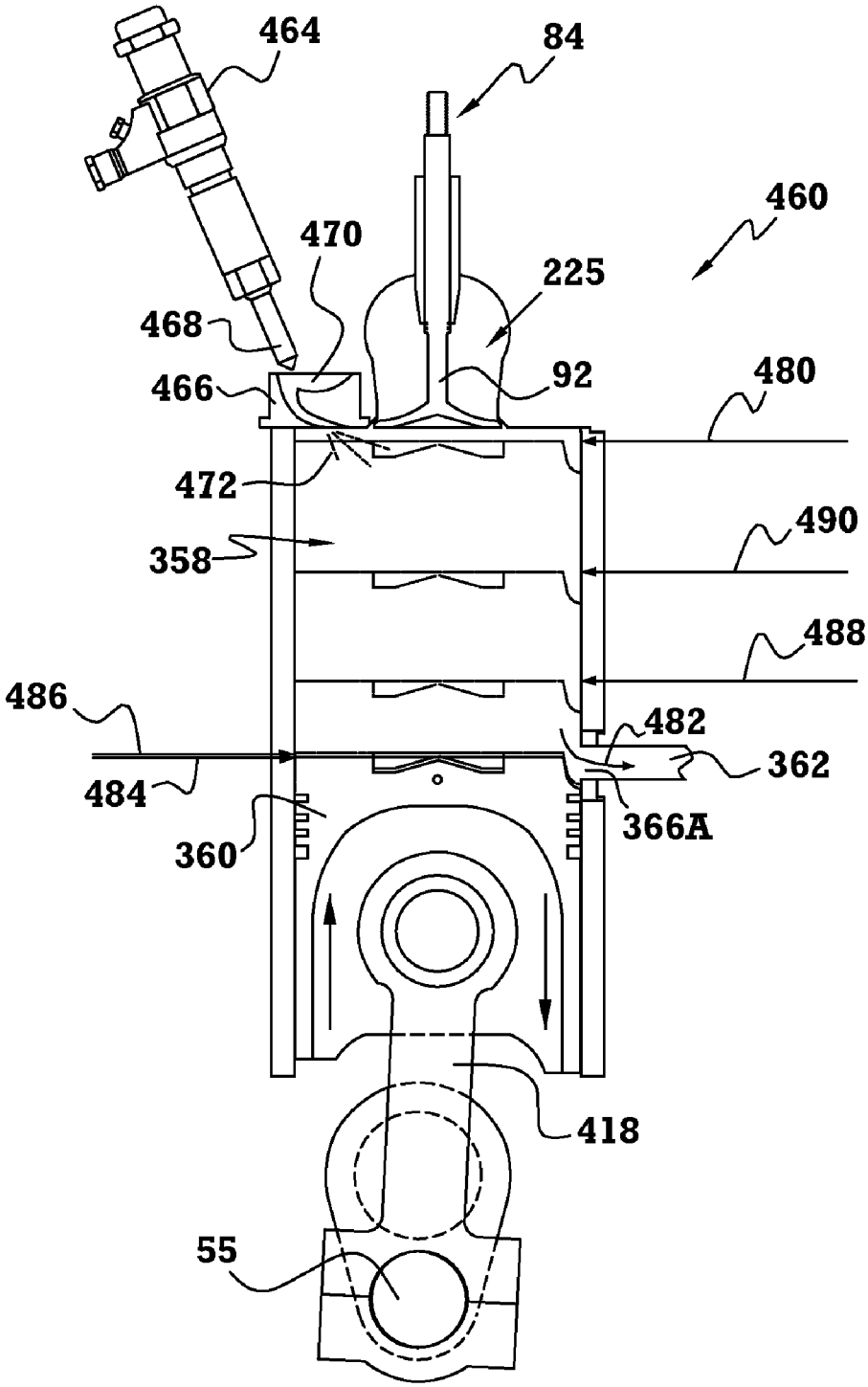
FIG. 34 is a front sectional view of an indirect injection engine cylinder with a piston head shown at different positions for operation as a two-cycle four-stroke engine.
Figure 35:
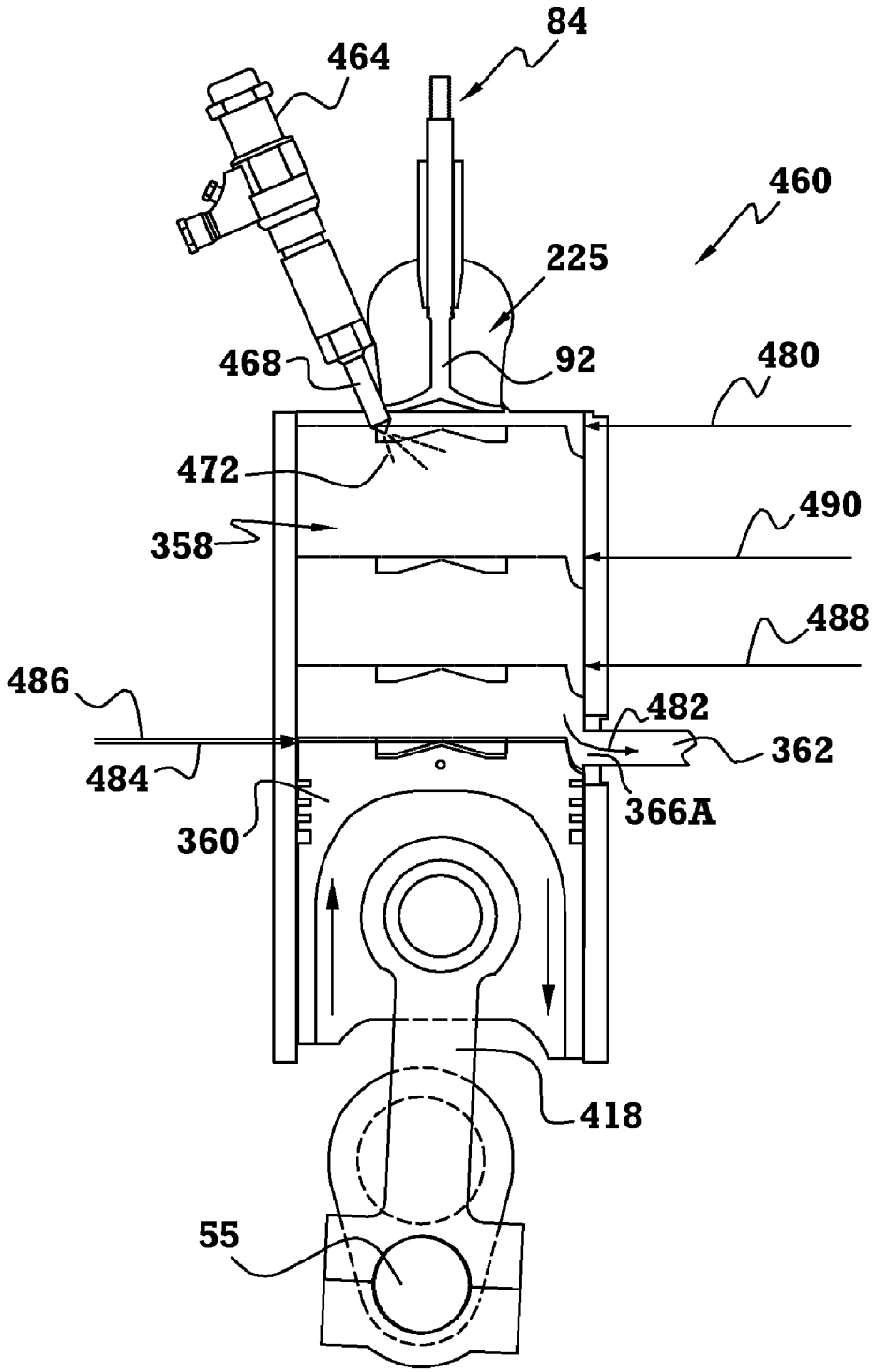
FIG. 35 is a front sectional view of a direct injection engine cylinder with a piston head shown at different positions for operation as a two-cycle four-stroke engine.

As shown in FIGS. 34 and 35, the system 440 can be used with both an indirect fuel injection configuration 460 (FIG. 34) and direct fuel injection (FIG. 35) systems. The indirect configuration 460 includes a fuel injector 464 that is preferably electronically controlled for delivering fuel at precise timing positions through a nozzle 468, and a post-injector module 466 in communication with the nozzle 468. The module 466 in accordance with the present invention includes a cavity 470 that is shaped to deliver fuel to the combustion chamber 358 in a spray pattern 472 ideal for mixture with air from the primary intake conduit 444 (FIGS. 31 and 32) and/or the secondary intake conduit 446.

The direct configuration 460 (FIG. 35) includes a fuel injector 464 with a nozzle 468 that is positioned within the combustion chamber 358 so that fuel can be delivered to the combustion chamber 358 in a spray pattern 472 ideal for mixture with air from the primary intake conduit 444 (FIGS. 31 and 32) and/or the secondary intake conduit 446.

In operation, the engine 10 may be running in the four-cycle mode as shown in FIG. 32, where the diverter valve 452 is in a first position to block the secondary intake conduit 446 and open the exhaust conduit 448. In order to switch operation to the two-cycle mode, the solenoid 454 is actuated to rotate the diverter valve to a second position to block the exhaust conduit 448 and open the secondary intake conduit 446. The closed loop control system 280 is preferably operable to activate a synchronous change in the position of each intake and exhaust valve assembly 82, 84 to accommodate the new timing requirements for two-cycle operation. Preferably, the timing for each cylinder is changed during subsequent revolutions according to the firing order of the cylinders, such that for a six cylinder engine, six revolutions of the crankshaft take place before the engine 10 is completely converted over to the two-cycle mode of operation. For a six cylinder engine running at 3500 RPM, the entire switch from four-cycle to two-cycle modes of operation in six revolutions is approximately 103 milliseconds. This is possible since the valve heads and piston heads are free running, i.e. the valve heads and piston heads will never contact each other, no matter what position the valves or pistons are in. It will be understood that the complete change from the four-cycle to two-cycle modes can take place in more or less revolutions of the crankshaft, such as in a single revolution. It will be further understood that all cylinders may be changed substantially at once or at other predetermined intervals or times.

Figure 36:
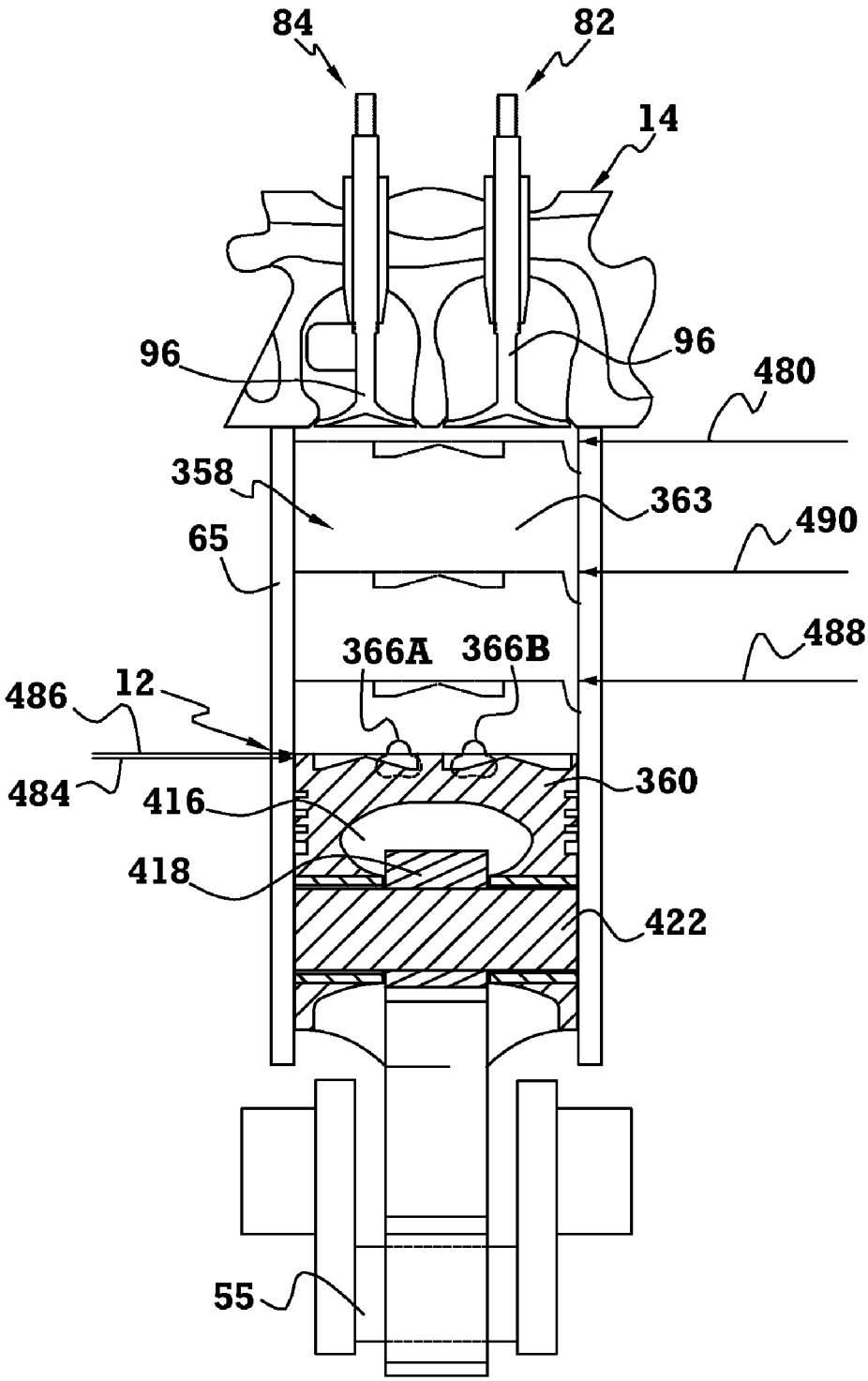
FIG. 36 is a side sectional view of the engine cylinder with the piston head shown at different positions during two-cycle four-stroke operation.

With additional reference to FIGS. 34-36, and in accordance with an exemplary embodiment of the invention, once the diverter valve 452 has been moved to the second position (FIG. 33) and the valve timing has been electronically adjusted, the expansion (explosion) stroke begins, as represented by piston head position 480. As the piston head travels toward the BDC with all the byproducts of combustion, the secondary exhaust ports 366A, 366B are exposed to relieve the combustion chamber 358 of the combustion byproducts as well as pressure and temperature as shown by arrow 482 and piston head position 484. At a predetermined time or piston head position 486, the intake and exhaust valve assemblies 82, 84 are opened to let fresh air into the cylinder as shown by arrows 474, 476 in FIG. 33, preferably under pressure from a turbocharger, supercharger, or the like (not shown).

The use of the exhaust valve assembly 84 as an intake valve enables the volume of fresh air to be regulated in accordance with sensed air mass and temperature within the cylinder. As the volume of the cylinder determines the stoichiometric relationship between the fuel and air, their consumption can be controlled at any instant in accordance with engine or power requirements by controlling the position of the intake valve assembly and/or exhaust valve assembly. Since the inlet pressure is greater than the outlet pressure (which should be at or close to atmosphere), the exhaust gas is swept toward the secondary exhaust ports 366A, 366B and expelled. Cylinder purging is further enhanced by the reduced speed of the piston head as it reaches BDC (where it momentarily has zero velocity). Upon reaching the BDC position, the turbocharger or supercharger should stop generating pressure in the cylinder in order to relieve piston braking, thus achieving a better ascending power of the piston within the cylinder.

During the compression stroke, the secondary exhaust ports 366A, 366B again become blocked and sealed from the combustion chamber 358 at approximately 68 degrees after BDC, as represented by piston head position 488, due to the upward movement the piston head 360 and the position of the piston rings (not shown) above the secondary exhaust ports 366A, 366B. The compression stroke continues, as represented by head position 490, until at a predetermined time, such as at 18 degrees (TDC), fuel is injected into the combustion chamber and combined with the fresh air. Explosion of the fuel/air mixture will then occur for diesel engines. For gasoline engines, the spark timing can be controlled by the closed loop system 280. In accordance with one exemplary embodiment of the invention for two-stroke valve timing, compression occurs at approximately 112°, expansion occurs at approximately 122°, exhaust occurs at approximately 110°, intake occurs at approximately 120°, and fuel injection occurs at approximately 18°. It will be understood that the timing values in degrees are approximate and can change substantially depending on the type of engine, number of cylinders, and so on.

In order to change from a two-cycle mode of operation to a four-cycle mode of operation, the position of the diverter valve 452 is reversed to block the secondary intake conduit 446 and open the primary exhaust conduit 448, and the closed loop system is operable to adjust the valve timing in accordance with a four-cycle engine as previously described. It will be understood that the transformation from four cycle to two cycle and back again can be accomplished with or without a turbocharger or supercharger. It will be further understood that the secondary intake conduit 446 and the diverter valve 452 may be eliminated if there is sufficient airflow between the primary intake port and the secondary exhaust port to adequately purge the cylinder after combustion. In this instance, the exhaust valve assembly may be programmed to remain closed during the entire two-cycle mode of operation.

Preferably, the crankshaft 55 is of the asymmetric type since, upon having one expansion stroke per revolution, a significant contribution to power and torque increase is realized. In addition, the position of the asymmetric crankshaft can be laterally offset from the central axes of the cylinders to regulate the speed with which the piston head 360 approaches and moves away from BDC. This technique is very efficient for evacuating exhaust gases from the cylinders since it increases the amount of time the secondary exhaust valves are open when the piston head reaches the end of its expansion stroke. When the piston head is at BDC, the connecting rod 418 is not aligned with the central axis of the cylinder, but rather forms an angle with the central axis such that, when the piston head rises, the connecting rod does not rub against the cylinder walls, thus eliminating power loss due to friction.

Although there are distinct advantages in using an asymmetric crankshaft, it will be understood that symmetric crankshafts may also be used.

Figure 37:
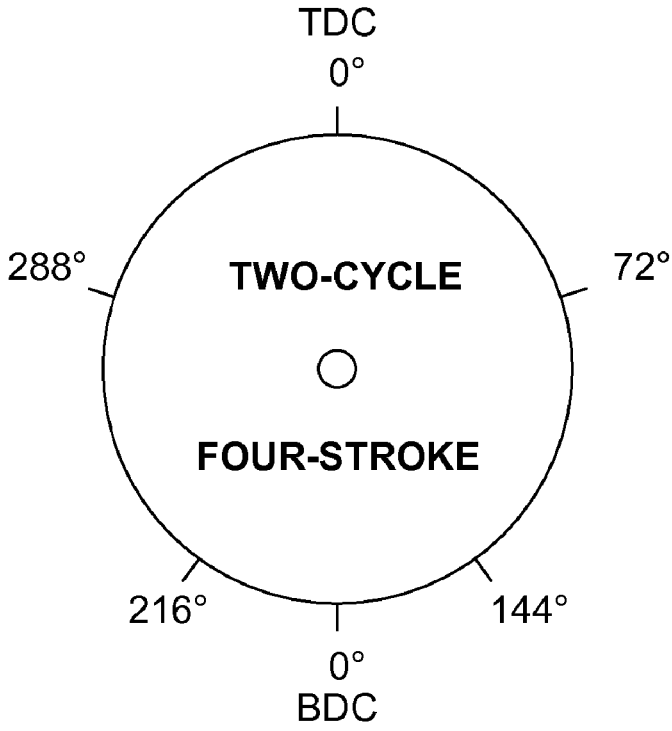
FIG. 37 is a schematic view of the timing for a two-stroke five-cylinder asymmetric engine.

Turning now to FIG. 37, a timing diagram for a five-cylinder engine with an asymmetric crankshaft is illustrated. The timing diagram reflects operation during the two-cycle mode of operation and includes explosions at 0° TDC, 72°, 144°, 216° and 288° degrees after TDC for the five cylinders. At 0° BDC, the electronic valve assemblies 82, 84 are open to purge the combustion gases from the cylinders and let in fresh air, as previously described.

When compared to the exemplary timing diagram of a four-cycle six cylinder engine with a symmetric crankshaft in FIG. 38, it is readily apparent that the present invention is adaptable to a wide variety of engine types and configurations in both the two-cycle and four-cycle modes of operation.

Referring now to FIGS. 39-44, an electronic valve assembly 500 in accordance with a further embodiment of the invention is illustrated. The valve assembly 500 preferably includes a stationary housing assembly 502, a stationary permanent magnet assembly 504 fixed within the housing assembly 502, a mobile coil assembly 506 that surrounds the permanent magnet assembly 504 and is mounted for reciprocal movement in the housing assembly, and a valve 508 mounted to the coil assembly 506 for movement therewith. The stationary housing assembly 502 preferably includes a heat transfer unit 505 connected to an upper magnet support portion 507 and a lower magnet support portion 509.

The permanent magnet assembly 504 and coil assembly 506 are preferably similar in construction to the magnet and coil assemblies previously described with the exception that the permanent magnet assembly 504 includes additional sets 154A, 154B of stacked permanent magnets 144 sandwiched between spacers 156A, 156B, respectively, and the coil assembly 506 includes additional coils 188A, 188B wrapped around the spool 180 for increasing power output of the electronic valve assembly. It will be understood that more or less permanent magnet sets and/or coils can be provided.

The heat transfer unit 505 preferably includes a generally cylindrical wall with an outer wall portion 510, an inner wall portion 512, an upper annular wall portion 514 extending between an upper end of the outer and inner wall portions, and a lower annular wall portion 516 extending between a lower end of the outer and inner wall portions to thereby form an internal cavity 518 through which liquid can flow for removing heat from the valve assembly 500 that may be generated during operation. The internal cavity 518 is in fluid communication with an upper outlet tube or port 520 and a lower inlet tube or port 522 so that liquid flow through the internal cavity is in an upward direction. It will be understood that the exit and entrance ports can be reversed so that liquid flow is in a downward direction.

The upper magnet support portion 507 preferably includes a generally cylindrical wall 524. An annular shoulder 526 is formed on the inner surface of the wall 524 and a plurality of circumferentially spaced bores 528 extend axially through the shoulder 526 for mating with corresponding circumferentially spaced threaded bores 530 formed in the upper wall portion 514. A central hub 532 is connected to a lower end of the upper magnet support 507 via a plurality of spokes 534. When assembled, the spokes 534 accommodate upper axially extending slots 536 of the coil assembly 506 during reciprocal movement of the coil assembly. A centrally located bore 538 is formed in the central hub 532 for receiving an upper threaded portion 540 of a central shaft 542 of the permanent magnet assembly 504. A threaded nut 539 is concentric with the bore 538 within the upper magnet support portion for engaging the upper threaded portion 540 of the shaft 542 to thereby rigidly secure the permanent magnet assembly to the upper magnet support portion 507.

A magnetic pick-up device 544 is positioned within a generally radially extending opening 546 in the wall 524 of the upper magnet support portion 507 for detecting the strength of a magnetic field as generated by a magnet 548 or other magnetic field generating device, such as a miniature coil, located on the upper end 549 of the coil assembly 506, for determining the position of the coil assembly, and thus the position of the valve 508. In this manner, the processor (as previously described) can receive feedback information regarding the position of each valve assembly to thereby control valve movement and timing with a greater degree of accuracy. It will be understood that positions of the pick-up device 544 and the magnetic field generating device 548 may be reversed and/or at other locations along the valve assembly 500. It will be further understood that other position detecting devices may alternatively be used.

An upper coil support portion 550 includes an upper wall 552 with openings 554 and a side wall 556 extending downwardly from the upper wall. An axially extending annular groove 558 is formed in the side wall 556 for receiving the upper end 549 of the coil assembly 506. Preferably, the upper coil support portion 550 is fixedly secured to the coil assembly 506 for movement therewith through well-known attachment means such as friction or press-fitting, adhesive bonding, welding, mechanical fastening, and so on. The openings 554 in the upper wall 552 ensure relatively free flow of air through the upper coil support portion 550 during reciprocal movement. An annular boss 560 extends upwardly from the upper wall 552 for receiving an inner ring 568 of an upper coil suspension member 564. A threaded bore 562 extends through the boss 560 and upper wall 552 for receiving a threaded fastener 566 for securing the inner ring 568 of the upper coil suspension member 564 to the upper coil support portion 550. The upper coil suspension member also includes an outer ring 570 with circumferentially spaced openings 572 that align with the bores 528 of the upper magnet support portion 507 when assembled. A flexible, corrugated circular panel 574 extends between the outer ring 570 and the inner ring 568 for accommodating movement of the coil assembly 506. An upper securing ring 578 seats against the outer ring 570 and includes circumferentially spaced openings 580 that are in alignment with the openings 572 of the outer ring.

Figure 44:
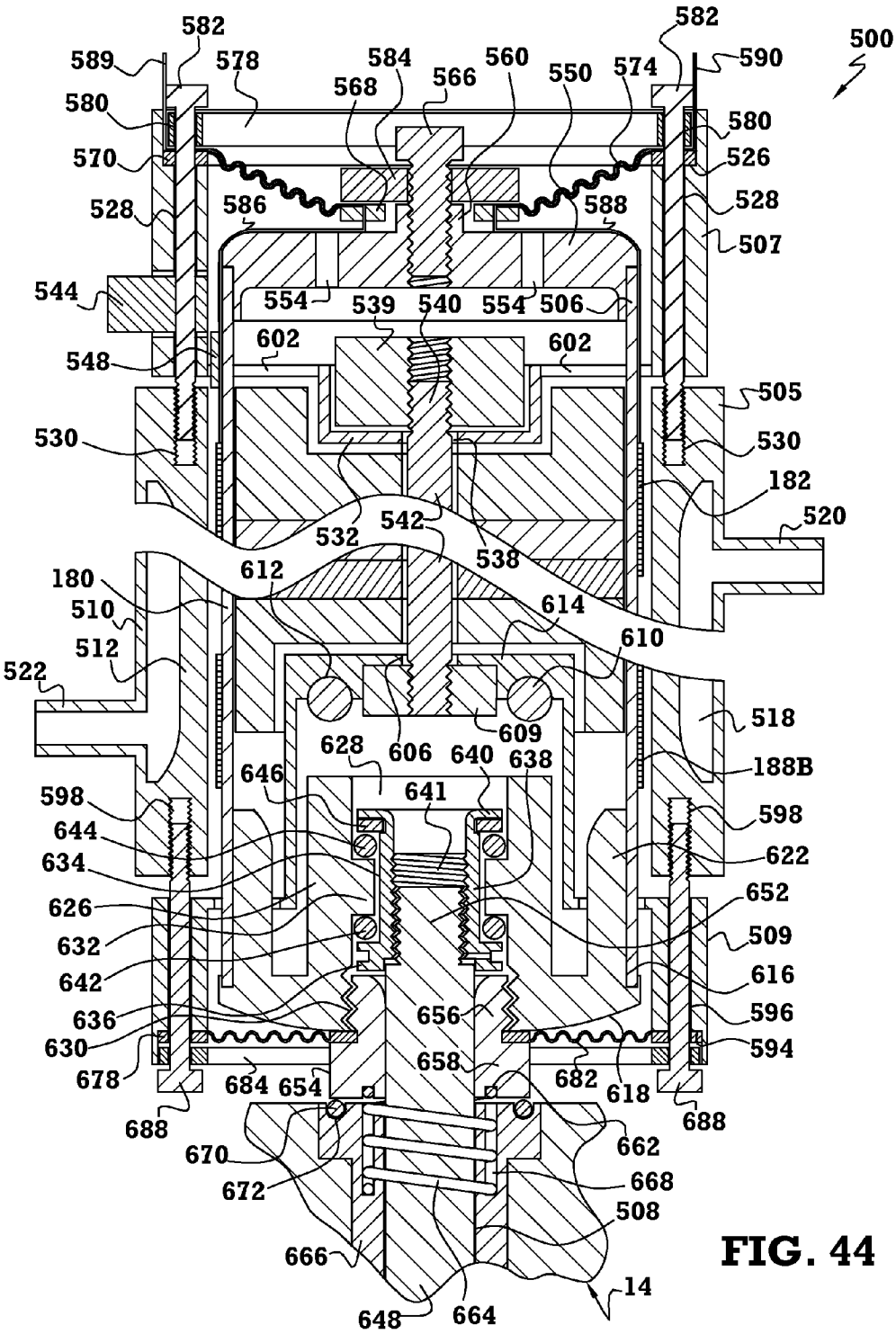
FIG. 44 is an enlarged front sectional view of upper and lower portions of the valve assembly of FIG. 39 in an open position.

As best shown in FIG. 44, a pair of resilient electrical contacts 586, 588 preferably extend from opposite sides of the coil assembly 506, upwardly around the upper coil support portion 550, through the corrugated panel 574, and upwardly to terminate in a pair of tabs 589, 590 for electrical connection to control circuitry (FIG. 11) for controlling movement of the valves between open and closed positions, as previously described. The contacts 586, 588 are electrically connected to opposite ends of the coils so that electrical current may flow in one direction for opening the valve and in the opposite direction for closing the valve as determined by the control circuitry.

The upper coil suspension member 564, including the panel 574 and contacts 586, 588, are preferably constructed of a shaped, woven mesh of beryllium copper covered with cotton fabric and carbon fiber impregnated with high heat resistance phenolic epoxy and coated with Kevlar sheeting. However, it will be understood that other materials can be used for the panel 574 and contacts 586, 588 such as flexible printed circuit material, reinforced elastomeric material with conductive elements or traces, other composite materials, and so on.

When assembled, threaded fasteners 582 extend through the openings 580 of the securing ring 578, the openings 572 of the outer ring 570, the bores 528 of the upper magnet support portion 507, and into the threaded bores 530 of the heat transfer unit 505 to thereby rigidly secure the outer ring 570 of the upper suspension member 564 to the upper magnet support portion 507. Likewise, the fastener 566 extends through a washer 584 that seats against the boss 560 and inner ring 568, and into the threaded bore 562 to rigidly secure the inner ring 568 to the upper coil support portion 550 for reciprocal movement therewith. An upper securing ring 578 seats against the outer ring 570 and includes openings 580 that are in alignment with the openings 572 of the outer ring.

The lower magnet support portion 509 preferably includes a generally cylindrical lower wall 592. An annular shoulder 594 is formed on the inner surface of the wall 592 and a plurality of bores 596 extend axially through the shoulder 594 for mating with lower threaded bores 598 formed in the lower wall portion 516. A central hub 600 is connected to an upper end of the lower magnet support 509 via a plurality of spokes 602. When assembled, the spokes 602 accommodate lower axially extending slots 604 of the coil assembly 506 during reciprocal movement of the coil assembly. A centrally located opening 606 extends through the upper wall 614 of the central hub 600 for receiving a lower threaded portion 608 of the central shaft 542 of the permanent magnet assembly 504. A threaded nut 509 is concentric with the opening 606 and located adjacent to the upper wall 614 within the lower magnet support portion for engaging the lower threaded portion 608 of the shaft 542 to thereby rigidly secure the permanent magnet assembly to the lower magnet support portion 509. An upper shock absorber 610, preferably in the form of a resilient O-ring, is positioned within a raceway 612 of the upper wall 614 of the central hub 600 and serves as a cushioning seat for the lower coil support portion 616 during upward travel of the valve 508 as it moves toward the uppermost or completely closed position. Preferably, the upper shock absorber 610 is constructed of an elastomeric material, such as Viton™ or other synthetic rubber.

The lower coil support portion 616 preferably includes a curved lower wall 618 and a side wall 622 extending upwardly from the lower wall for receiving the lower end 626 of the coil assembly 506. Preferably, the lower coil support portion 616 is fixedly secured to the coil assembly 506 for movement therewith. To that end, the outer diameter of the side wall 622 is preferably equal to or slightly less than the inner diameter of the spool 180 so that the side wall 622 frictionally engages the inner surface of the spool. The lower coil support portion 616 may be secured to the coil assembly 506 through additional or alternative attachment means, such as adhesive bonding, welding, mechanical fastening, and so on. Axially extending grooves 624 are formed in the side wall 622 at equally spaced positions around the circumference of the side wall to accommodate the radially extending spokes 602 of the lower magnet support portion 509. An annular sleeve 626 extends upwardly from the lower wall 618 and is received within the central hub 600 for reciprocal movement with respect thereto. A bore 628 extends through the curved lower wall 618 and the sleeve 626 of the lower coil support portion 616 and includes a lower threaded portion 630 and an intermediate step portion 632.

A valve mount 634 is located within the bore 628 and includes a generally cylindrical body with an enlarged head portion 636 positioned on one side of the step portion 632, an intermediate portion 638 coincident with the step portion 632, a reduced diameter portion 640 positioned on the other side of the step portion, and an internally threaded bore 641 that extends through the head portion 636 and the intermediate portion 638. During assembly, a first O-ring 642 is slipped onto the intermediate portion 638 and the valve mount 634 is inserted into the bore 628 until the reduced diameter portion 640 clears the step portion 632. A second O-ring 644 and a retaining ring 646 are then slipped onto the intermediate portion 638 on the opposite side of the step portion 632 and the reduced diameter portion is bent or otherwise deformed over the retaining ring to thereby secure the valve mount 634 to the lower coil support portion 616. With this construction, the valve mount 634 is retained axially within the lower coil support portion 616 but may rotate about its central axis with respect to the coil assembly.

As best shown in FIGS. 39-41 and 44, the valve 508 is similar in construction to the valve 96 previously described and preferably includes a valve stem 648 and a valve head 650 located at a lower end of the valve stem. The upper end of the valve stem 648 has a threaded portion 652 (FIG. 44) that engages the internally threaded bore 641 of the valve mount 634. With this arrangement, the valve 508 reciprocates with the coil assembly 506 and may rotate about the central axis. In this manner, the rotational position of the valve head 650 and valve seat 223, 227 (FIG. 45) may change to thereby ensure even wear between the valve head and seat. Also, the valve is not rigidly connected to the coil, but has a more resilient connection that, together with the rotational effect, provides both damping and noise attenuation during operation.

Referring again to FIGS. 39-44, a spring mount 654 includes an externally threaded section 656 that engages the central threaded opening 630 of the lower coil support portion 616, a head section 658 that extends downwardly from the threaded section 656, and a bore 660 that extends through the threaded and head sections. The bore 660 is sized to slidably receive the valve stem 648. An annular groove 662 is formed in the lower surface of the head section 658 for receiving a compression spring 664. A valve sleeve 666 of the cylinder head 14 includes an annular groove 668 for receiving an opposite end of the compression spring 664.

A lower shock absorber 670, preferably in the form of a resilient O-ring, is positioned in an annular groove 672 of the valve sleeve 666 and cushions downward movement of the coil assembly 506 as it moves toward the lower-most or completely open position. Preferably, the lower shock absorber 670 is constructed of an elastomeric material, such as Viton™ or other synthetic rubber. It will be understood that the upper and/or lower shock absorbers can be eliminated and/or replaced by varying the velocity at which the valve 508 approaches its seated or open positions through the valve control system 280 (FIG. 11), as previously discussed.

A lower coil suspension member 674 preferably includes an inner ring 676, an outer ring 678 with circumferentially spaced openings 680, and a flexible, corrugated circular panel 682 that extends between the inner and outer rings for accommodating movement of the coil assembly 506. When assembled, the inner ring 676 is sandwiched between the lower wall 618 of the lower coil support portion 616 and the head section 658 of the spring mount 654 so that the inner ring 676 moves with the coil assembly 506. Likewise, the outer ring 678 is sandwiched between the shoulder 594 of the lower magnet support portion 509 and a lower securing ring 684. The lower securing ring 684 preferably includes circumferentially spaced openings 686 aligned with the bores 596 of the lower magnet support portion 509 which are in turn aligned with the lower threaded bores 598 of the heat transfer unit 505.

When assembled, threaded fasteners 688 extend through the openings 686 of the lower securing ring 685, the openings 680 of the outer ring 678, the bores 596 of the lower magnet support portion 509, and into the threaded bores 598 of the heat transfer unit 505 to thereby rigidly secure the outer ring 678 of the lower coil suspension member 674 to the lower magnet support portion 509.

The lower coil suspension member 674 is preferably constructed of an appropriately shaped sheet of perforated steel covered with cotton fabric and resinated carbon fiber with high resistance phenolic epoxy and coated with Kevlar sheeting. However, it will be understood that other materials can be used for the lower coil suspension member 674 such as reinforced elastomeric material, and so on.

Preferably, the heat transfer unit 505 and spacers 146, 148, 152, 156, 156A, and 156B are constructed of a magnetically permeable material, while the upper and lower magnet support portions 507, 509 and the rod 542 are constructed of a nonmagnetic material, such as 316L stainless steel, since the magnetic circuits, as previously described, close between the spacers, heat transfer unit and permanent magnets. In accordance with one exemplary embodiment of the invention, the heat transfer unit and spacers may be constructed of an iron-based material having approximately 0.02% carbon, 0.31% manganese, 0.01% silicon, 0.013% phosphorus, and 0.015% sulfur. This material is preferably thermally treated in order to globulize the perlite and thus obtain a ferrous matrix with low iron carbide content. Consequently, the heat transfer unit and spacers feature a high magnetic permeability. It will be understood that other materials for the heat transfer unit, spacers, cap and rod can be used. By way of example, the coil assembly 506 may adequately function even when the spacers are constructed with non-ferromagnetic material. Thus, the spacers, magnet support portions and rod may be constructed of suitable non-magnetic metals such as aluminum, composite materials, plastics, and so on.

In addition, although the valve assembly 500 has been described with various parts being generally cylindrical in shape with particular relative sizes, it will be understood that the valve assembly may be constructed of various shapes and sizes to accommodate a wide range of automotive, and industrial requirements.

Figure 45:
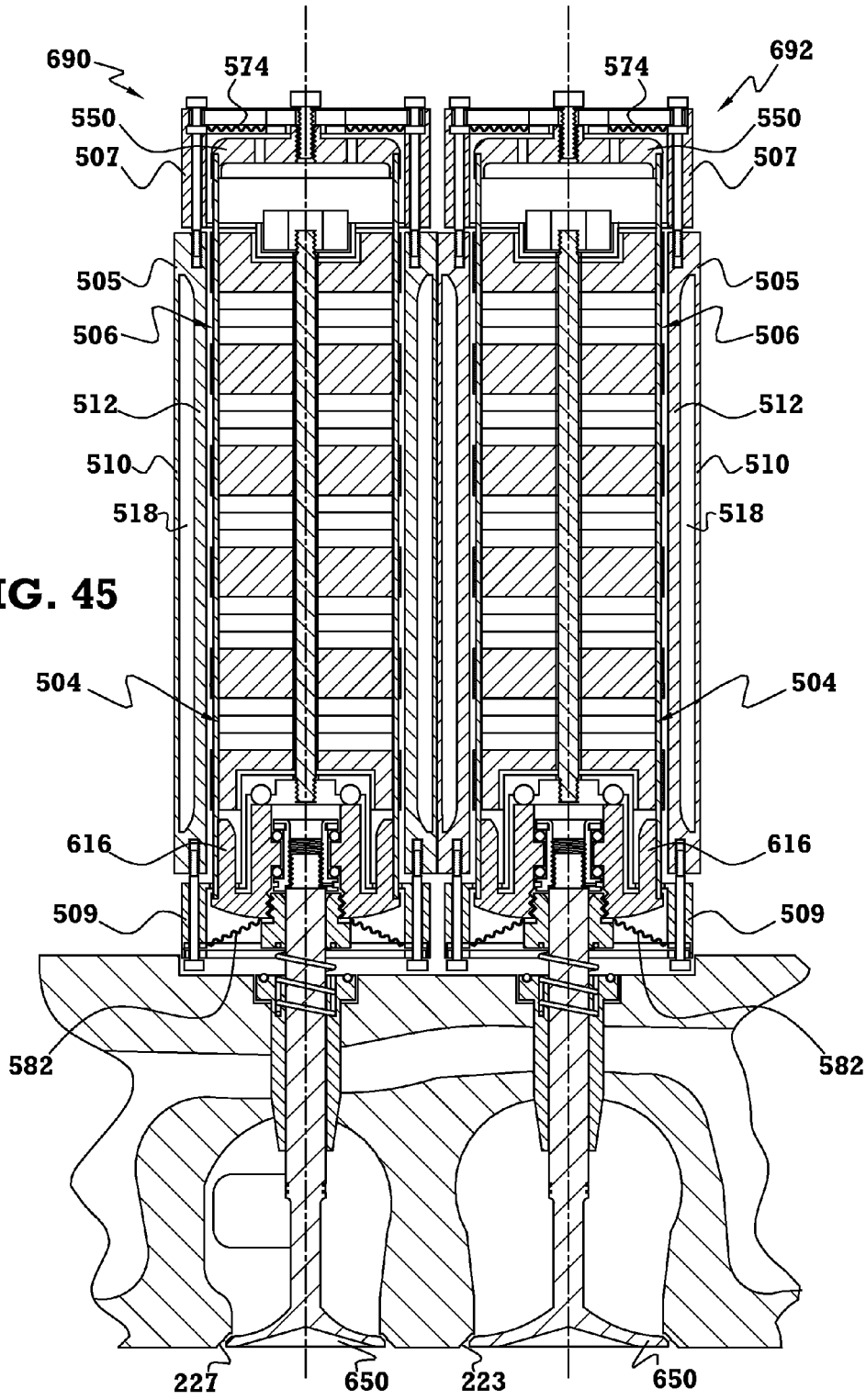
FIG. 45 is a side sectional view of an electronic valve system showing both intake and exhaust valve assemblies in accordance with the FIG. 39 embodiment with their respective valves in the closed position.
Figure 46:
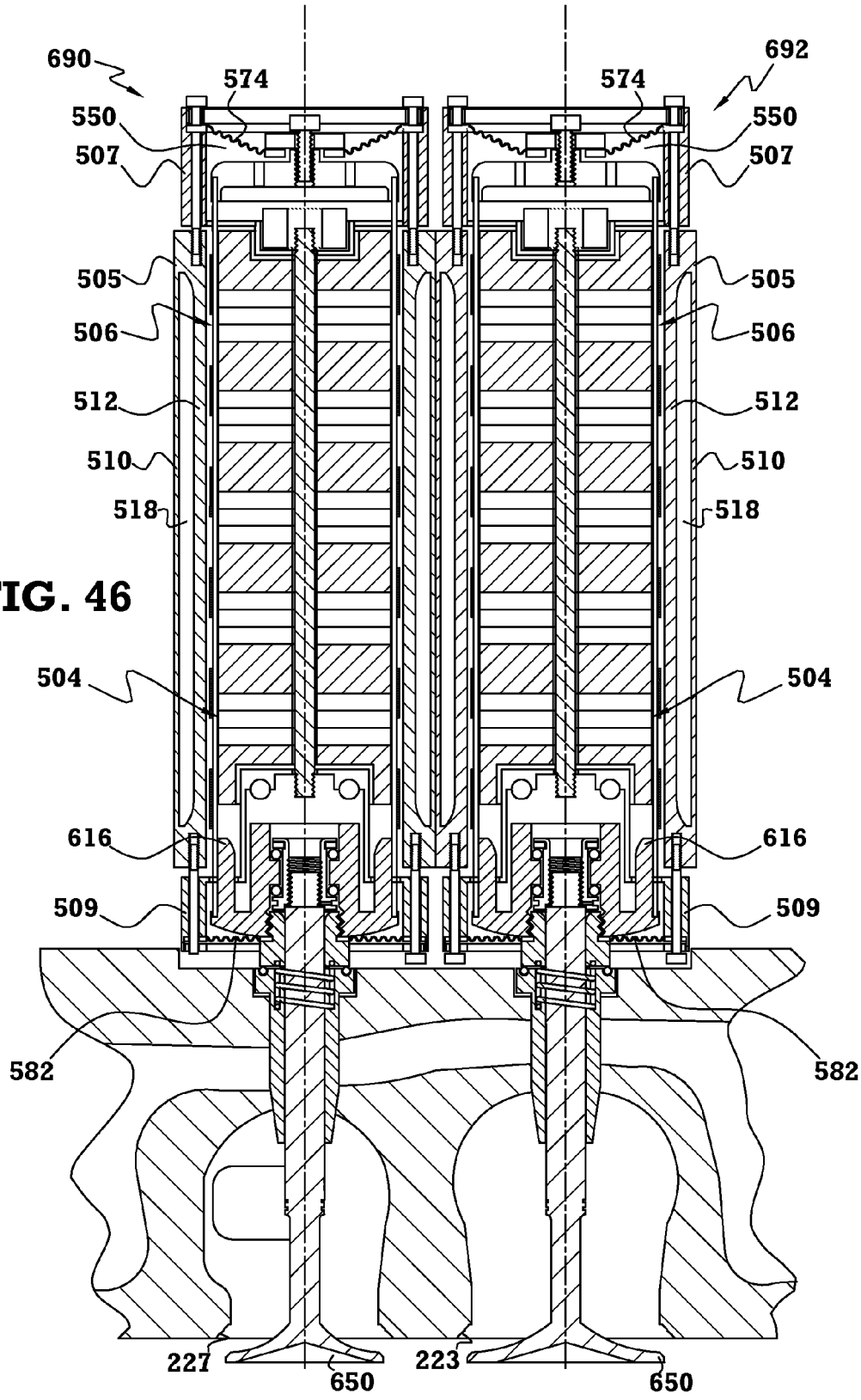
FIG. 46 is a sectional view similar to FIG. 45 with the valves in the open position.

In operation, and with additional reference to FIGS. 45 and 46, the valve assembly 500 may be embodied as either an intake valve assembly 690 or an exhaust valve assembly 692 and two or more valve assemblies may be juxtaposed for multi-valve systems. Due to the construction and materials of the housing assembly 502, permanent magnet assembly 504, coil assembly 506, and the location of the compression spring 664 between the valve sleeve 666, the intake and exhaust valve assemblies 690, 692 are initially in a closed position (FIG. 45) before electrical power is applied to the coil assemblies. When an electrical current is applied to the coils of one or both of the valve assemblies 690 and 692, the coil assembly 506 and thus the valve 508 is moved downwardly toward the open position against the force of the spring 664, as shown in FIG. 46. In this position, the upper flexible corrugated panel 574 of the upper coil suspension member 564 is generally conical in shape, while the lower flexible corrugated panel 682 of the lower coil suspension member 674 is generally planar in shape. When an electrical current is applied to the coils in the opposite direction, the coil assembly 506 and thus the valve 508 is moved upwardly toward the closed position, as shown in FIG. 45. In this position, the upper flexible corrugated panel 574 of the upper coil suspension member 564 is generally planar in shape, while the lower flexible corrugated panel 682 of the lower coil suspension member 674 is generally conical in shape. Prior to closure of the valve, the spring helps opposes the reverse current and thus achieves a softer and quieter closure. It will be understood that electrical current in the reverse direction may not be needed since the spring 664 may be constructed of sufficient strength for returning the valve to the closed position. In addition, depending on the strength of the spring, electrical current may be applied to the coils in the same direction for both opening and closing the valves. When the valve is closing, the electrical current and thus the generated magnetic fields may be substantially lower than that required to open the valve and/or the current may be pulsed, stepped, etc. as previously described to dampen or control the precise position of the valve.

Figure 47:
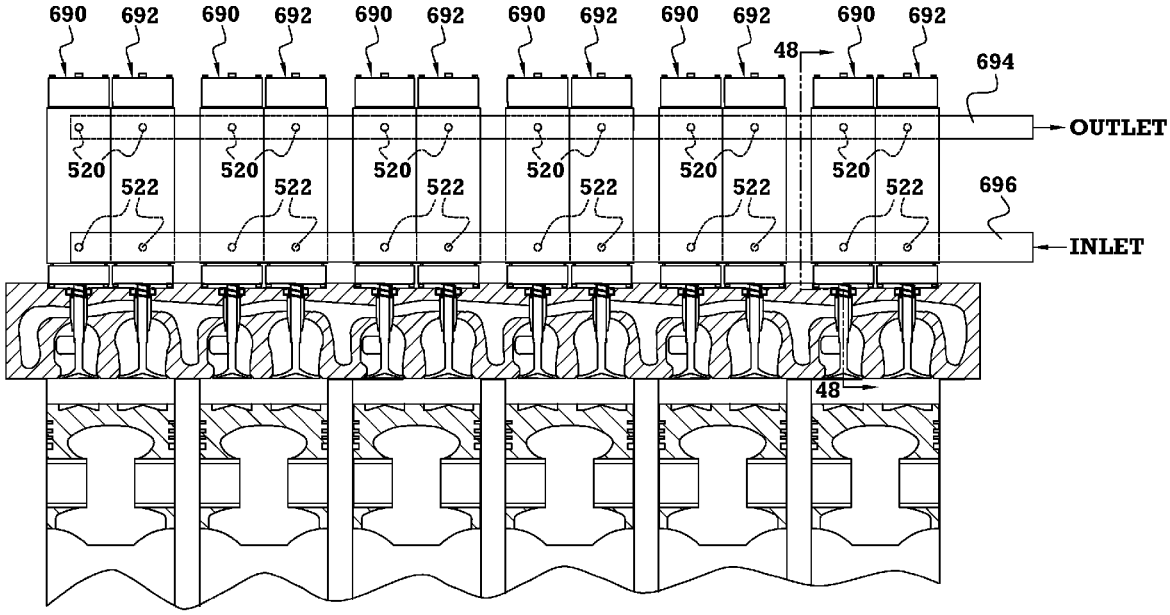
FIG. 47 is a schematic view of the liquid cooling circuit for a plurality of valve assemblies with a cross section through the engine head and block.
Figure 48:
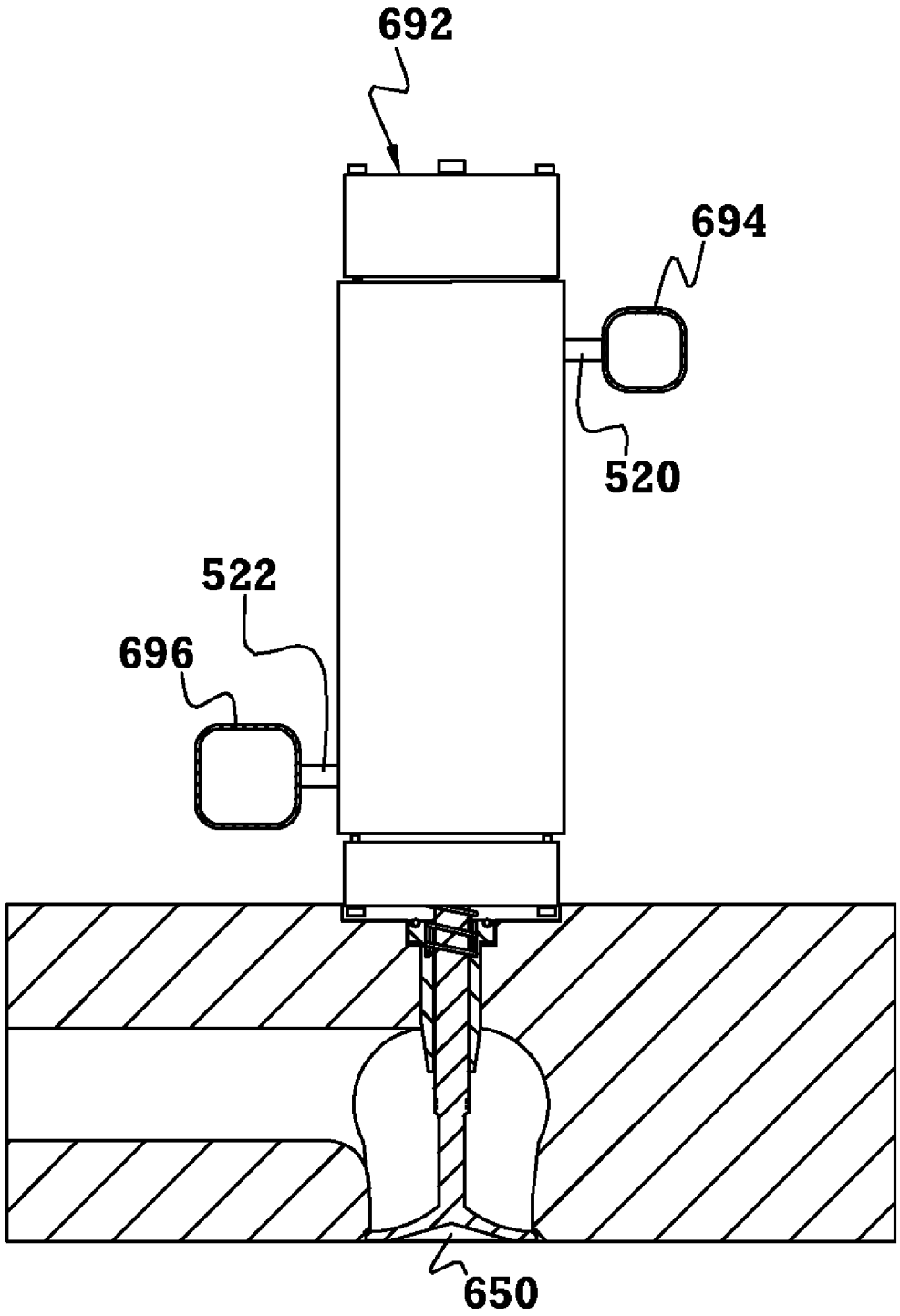
FIG. 48 is a schematic view of a liquid cooling circuit for a single valve assembly taken along line 48-48 of FIG. 47.

Referring now to FIGS. 47 and 48, the upper outlet tube or port 520 of each valve assembly 690, 692 is preferably fluidly connected to a common upper outlet conduit 694 and the lower inlet tube or port 522 is preferably connected to a common lower inlet conduit 696. The conduits 694, 696 are in turn fluidly connected to a liquid reservoir, such as a radiator 20 (FIG. 1) or the like such that cooling liquid from the reservoir enters the inlet port 522 of each valve assembly, circulates within the internal cavity 518 of each heat transfer unit 505, and exits the outlet port 520 for return and subsequent cooling in the reservoir. The circulation of cooling liquid, such as water, antifreeze, combinations thereof or the like, helps to reduce or eliminate heat that may be generated by the coils. Eddies and currents that may be induced by electromagnetic field within the internal cavity 518 may alter the flow of fluid and thus enhance the cooling effect. It should be noted that the electronic valve assemblies 690, 692 as presently configured do not need lubricating oil and are sufficiently cooled to preclude additional cooling means.

It will be understood that the term "preferably" as used throughout the specification refers to one or more exemplary embodiments of the invention and therefore is not to be interpreted in any limiting sense.

In addition, terms of orientation and/or position as may be used throughout the specification, such as but not limited to: forwardly, upper, middle, lower, upwardly, downwardly, inwardly, front, side, as well as their respective derivatives and equivalent terms, relate to relative rather than absolute orientations and/or positions.

It will be appreciated by those skilled in the art that changes could be made to the embodiments described above without departing from the broad inventive concept thereof. By way of example, although less efficient, the coil assembly can be held stationary while the permanent magnet assembly is arranged for linear movement when current is applied to the coil assembly. It will be understood, therefore, that this invention is not limited to the particular embodiments disclosed, but is intended to cover modifications within the spirit and scope of the present invention as defined by the appended claims.

I claim:

1. A linear actuator comprising:

a stationary permanent magnet assembly having at least one permanent magnet for generating a permanent magnetic field;

a movable coil assembly having at least one coil of electrically conductive material for generating a temporary magnetic field to thereby move the movable coil assembly with respect to the stationary permanent magnet assembly, the movable coil assembly surrounding the stationary permanent magnet assembly; and a heat transfer unit surrounding at least a portion of the movable coil assembly for removing heat generated by the at least one coil during operation, the heat transfer unit comprising a wall with an internal cavity, an inlet port in fluid communication with the internal cavity and an outlet port in fluid communication with the internal cavity and spaced from the outlet port so that cooling liquid can be circulated through the internal cavity between the inlet and outlet ports;

an upper magnet support portion rigidly connected to an upper end of the heat transfer unit and a lower magnet support portion rigidly connected to a lower end of the heat transfer unit with the stationary permanent magnet assembly being rigidly connected to the upper and lower magnet supports; and an upper coil suspension member extending between the upper magnet support portion and an upper end of the movable coil assembly, and a lower coil suspension member extending between the lower magnet support portion and a lower end of the movable coil assembly.

2. A linear actuator according to claim 1, wherein each coil suspension member comprises an outer ring rigidly connected to its respective magnet support portion, an inner ring rigidly connected to its respective coil assembly end, and a flexible circular panel extending between the outer and inner rings.

3. A linear actuator according to claim 2, wherein the flexible panel is corrugated.

4. A linear actuator according to claim 2, and further comprising an upper coil support portion rigidly connected to the movable coil assembly upper end and a lower coil support portion rigidly connected to the movable coil assembly lower end, with the inner ring of each coil suspension member being rigidly connected to its respective coil support portion.

5. A linear actuator according to claim 4, and further comprising a pair of electrical contacts electrically connected to opposite ends of the at least one coil and extending through the upper coil suspension member.

6. An electronic valve assembly comprising the linear actuator of claim 4 for an internal combustion engine having a combustion chamber with a valve seat, the electronic valve assembly further comprising a valve having a valve stem with one end connected to the lower coil support portion and a valve head connected to an opposite end of the valve stem, the valve being movable with the movable coil assembly between a closed position wherein the valve head is adapted for contacting the valve seat and an open position wherein the valve head is spaced from the valve seat.

7. An electronic valve assembly according to claim 6, and further comprising a valve sleeve adapted for mounting to the internal combustion engine and a compression spring positioned between the valve sleeve and the lower coil support to thereby bias the movable coil assembly to the closed position in the absence of electric current to the at least one coil.

8. An internal combustion engine comprising at least two electronic valve assemblies according to claim 7, the internal combustion engine further comprising:

an engine block having a cylinder formed therein;

a piston having a piston head for reciprocal movement in the cylinder; and a cylinder head connected to the engine block and having an intake port and an exhaust port, with one of the electronic valve assemblies being operable to open and close the intake port and the other of the electronic valve assemblies being operable to open and close the exhaust port.

9. An electronic valve assembly comprising the linear actuator of claim 1 for an internal combustion engine having a combustion chamber with a valve seat, the electronic valve assembly further comprising a valve having a valve stem with one end connected to the movable coil assembly and a valve head connected to an opposite end of the valve stem, the valve being movable with the movable coil assembly between a closed position wherein the valve head is adapted for contacting the valve seat and an open position wherein the valve head is spaced from the valve seat.

10. An electronic valve assembly according to claim 9, and further comprising a valve sleeve adapted for mounting to the internal combustion engine and a compression spring positioned between the valve sleeve and the movable coil assembly to thereby bias the movable coil assembly to the closed position in the absence of electric current to the at least one coil.

11. A linear actuator according to claim 1, wherein the heat transfer unit comprises a wall with an internal cavity, an inlet port in fluid communication with the internal cavity and an outlet port in fluid communication with the internal cavity and spaced from the outlet port so that cooling liquid can be circulated through the internal cavity between the inlet and outlet ports.

12. An electronic valve assembly comprising:

a housing assembly having upper and lower magnet support portions;

a permanent magnet assembly having at least one permanent magnet for generating a permanent magnetic field, the permanent magnet assembly being rigidly connected to the upper and lower magnet support portions;

a coil assembly surrounding the permanent magnet assembly within the housing, the coil assembly having at least one coil of electrically conductive material for generating a temporary magnetic field to thereby move the coil assembly in an axial direction with respect to the permanent magnet assembly;

upper and lower coil support portions rigidly connected to upper and lower ends, respectively, of the coil assembly;

an upper coil suspension member having an upper outer ring rigidly connected to the upper magnet support portion, an upper inner ring rigidly connected to the upper coil support portion, and an upper flexible circular panel extending between the upper outer and inner rings;

a lower coil suspension member having a lower outer ring rigidly connected to the lower magnet support portion, a lower inner ring rigidly connected to the lower coil support portion, and a lower flexible circular panel extending between the lower outer and inner rings; and a valve having a valve stem with one end connected to the lower coil support portion and a valve head connected to an opposite end of the valve stem, the valve being movable with the coil assembly between a closed position wherein the valve head is adapted for contacting a valve seat and an open position wherein the valve head is spaced from the valve seat.

13. An electronic valve assembly according to claim 12, and further comprising a compression spring operably associated with the coil assembly for biasing the coil assembly to the closed position in the absence of electric current to the at least one coil.

14. An electronic valve assembly according to claim 12, wherein the housing assembly further comprises a heat transfer unit having a wall with an internal cavity that surrounds the coil assembly, an inlet port in fluid communication with the internal cavity and an outlet port in fluid communication with the internal cavity and spaced from the outlet port so that cooling liquid can be circulated through the internal cavity between the inlet and outlet ports for removing heat generated by the at least one coil during operation.

15. An electronic valve assembly according to claim 12, and further comprising a pair of electrical contacts electrically connected to opposite ends of the at least one coil and extending through the upper coil suspension member and out of the housing.

* * * * *